US011572803B1

(12) United States Patent
Lacy et al.

(10) Patent No.: US 11,572,803 B1
(45) Date of Patent: Feb. 7, 2023

(54) TURBINE AIRFOIL WITH LEADING EDGE COOLING PASSAGE(S) COUPLED VIA PLENUM TO FILM COOLING HOLES, AND RELATED METHOD

(71) Applicant: General Electric Company, Schenectady, NY (US)

(72) Inventors: Benjamin Paul Lacy, Greer, SC (US); Ibrahim Sezer, Greenville, SC (US); Brad Wilson VanTassel, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/816,574

(22) Filed: Aug. 1, 2022

(51) Int. Cl.
*F01D 25/12* (2006.01)
*F01D 9/04* (2006.01)

(52) U.S. Cl.
CPC ..... *F01D 25/12* (2013.01); *F01D 9/04* (2013.01); *F05D 2220/30* (2013.01); *F05D 2240/128* (2013.01); *F05D 2260/202* (2013.01)

(58) Field of Classification Search
CPC . F01D 25/12; F01D 25/08; F01D 9/04; F01D 5/08; F01D 5/081; F01D 5/147; F01D 5/18; F05D 222/30; F05D 2240/30; F05D 2260/202
See application file for complete search history.

(56) References Cited

U.S. PATENT DOCUMENTS

| | | | |
|---|---|---|---|
| 5,637,239 | A | 6/1997 | Adamski et al. |
| 6,099,251 | A | 8/2000 | LaFleur |
| 6,644,920 | B2 | 11/2003 | Beeck et al. |
| 7,306,026 | B2 | 12/2007 | Memmen |
| 7,510,367 | B2 | 3/2009 | Liang |
| 8,517,667 | B1 | 8/2013 | Liang |
| 8,523,527 | B2 | 9/2013 | Lacy et al. |
| 8,651,805 | B2 | 2/2014 | Lacy et al. |
| 8,672,613 | B2 | 3/2014 | Bunker |
| 8,678,766 | B1 | 3/2014 | Liang |
| 8,753,083 | B2 | 6/2014 | Lacy et al. |
| 8,770,936 | B1 | 7/2014 | Liang |
| 8,864,469 | B1 | 10/2014 | Liang |
| 9,416,662 | B2 | 8/2016 | Morgan et al. |
| 9,669,458 | B2 | 6/2017 | Weber et al. |
| 9,828,915 | B2 | 11/2017 | Miranda et al. |

(Continued)

*Primary Examiner* — Igor Kershteyn
(74) *Attorney, Agent, or Firm* — James Pemrick; Charlotte Wilson; Hoffman Warnick LLC

(57) ABSTRACT

A turbine airfoil includes a body including a wall defining pressure and suction sides, and a leading edge extending between the pressure and suction sides. A cooling circuit inside the wall of the body includes at least one of: a) a suction side to pressure side cooling sub-circuit including a first cooling passage(s) extending from the suction side to the pressure side around the leading edge to a first plenum, and a plurality of first film cooling holes communicating with the first plenum and extending through the wall on the pressure side; and b) a pressure side to suction side cooling sub-circuit including second cooling passage(s) extending from the pressure side to the suction side around the leading edge to a second plenum, and a plurality of second film cooling holes communicating with the second plenum and extending through the wall on the suction side.

20 Claims, 16 Drawing Sheets

(56) References Cited

U.S. PATENT DOCUMENTS

| | | | | |
|---|---|---|---|---|
| 9,970,302 | B2 | 5/2018 | Lacy et al. | |
| 9,995,172 | B2 | 6/2018 | Dutta et al. | |
| 10,030,537 | B2 | 7/2018 | Dutta et al. | |
| 10,221,719 | B2 | 3/2019 | Benjamin et al. | |
| 10,352,181 | B2 | 7/2019 | Vogel et al. | |
| 10,458,253 | B2 | 10/2019 | Mongillo, Jr. | |
| 10,598,028 | B2 | 3/2020 | Hoskin et al. | |
| 10,626,731 | B2 | 4/2020 | Barker et al. | |
| 10,648,341 | B2 | 5/2020 | Barker et al. | |
| 10,704,396 | B2 | 7/2020 | LoRicco et al. | |
| 10,767,492 | B2 | 9/2020 | Webster et al. | |
| 10,830,049 | B2 | 11/2020 | Clum et al. | |
| 10,934,856 | B2 | 3/2021 | Srinivasan et al. | |
| 11,015,456 | B2 | 5/2021 | Vogel et al. | |
| 2012/0201653 | A1* | 8/2012 | Moga | F01D 5/187 415/115 |
| 2012/0301319 | A1 | 11/2012 | Lacy et al. | |
| 2015/0086408 | A1 | 3/2015 | Kottilingam et al. | |
| 2015/0152737 | A1 | 6/2015 | Liang | |
| 2016/0208705 | A1* | 7/2016 | Slavens | F01D 25/30 |
| 2017/0030199 | A1 | 2/2017 | Barker et al. | |
| 2017/0089207 | A1 | 3/2017 | Marsh et al. | |
| 2017/0260873 | A1 | 9/2017 | Lacy et al. | |
| 2018/0283183 | A1* | 10/2018 | Gallier | F01D 9/04 |
| 2018/0363470 | A1 | 12/2018 | Snider et al. | |
| 2019/0024520 | A1 | 1/2019 | Underwood et al. | |
| 2019/0040745 | A1* | 2/2019 | Clark | F01D 9/065 |
| 2020/0049016 | A1 | 2/2020 | Barker et al. | |
| 2020/0072469 | A1 | 3/2020 | Theuer et al. | |
| 2020/0370436 | A1 | 11/2020 | Vogel et al. | |
| 2020/0386103 | A1 | 12/2020 | Generale et al. | |
| 2021/0332707 | A1* | 10/2021 | Dyson | F01D 5/187 |

* cited by examiner

TURBINE AIRFOIL WITH LEADING EDGE COOLING PASSAGE(S) COUPLED VIA PLENUM TO FILM COOLING HOLES, AND RELATED METHOD

STATEMENT REGARDING FEDERALLY SPONSORED RESEARCH

This invention was made with government support under Grant No. DE-FE0031611 awarded by the Department of Energy. The government has certain rights in the invention.

TECHNICAL FIELD

The disclosure relates generally to turbomachines and, more particularly, to a turbine airfoil with cooling passages in the leading edge that communicate coolant around the leading edge to a plenum and then to film cooling holes. A turbine nozzle including the airfoil and a related method of cooling the airfoil are provided also.

BACKGROUND

Leading edges of turbine airfoils are typically cooled with a set of outwardly directed cooling holes in the leading edge of the airfoil. The cooling holes are fluidly coupled via cooling passages to a coolant source in the body of the airfoil. The location of the cooling holes affects the amount of coolant needed to effectively cool the leading edge. Reducing the coolant volume through improved coolant delivery systems would positively impact gas turbine efficiency and output.

BRIEF DESCRIPTION

All aspects, examples and features mentioned below can be combined in any technically possible way.

An aspect of the disclosure provides a turbine airfoil, comprising: a body including a wall defining a pressure side, a suction side and a leading edge extending between the pressure side and the suction side; and a cooling circuit inside the wall of the body, the cooling circuit including at least one of: a) a suction side to pressure side cooling sub-circuit including at least one first cooling passage extending inside the wall of the body from the suction side to the pressure side around the leading edge to a first plenum defined in the wall on the pressure side, and a plurality of first film cooling holes in fluid communication with the first plenum and extending through the wall on the pressure side, wherein a first coolant from a first coolant source flows in the at least one first cooling passage and the first plenum and exits through the plurality of first film cooling holes; and b) a pressure side to suction side cooling sub-circuit including at least one second cooling passage extending inside the wall of the body from the pressure side to the suction side around the leading edge to a second plenum defined in the wall on the suction side, and a plurality of second film cooling holes in fluid communication with the second plenum and extending through the wall on the suction side, wherein a second coolant from a second coolant source flows in the at least one second cooling passage and the second plenum and exits through the plurality of second film cooling holes.

Another aspect of the disclosure includes any of the preceding aspects, and the cooling circuit includes both the pressure side to suction side cooling sub-circuit, and the suction side to pressure side cooling sub-circuit.

Another aspect of the disclosure includes any of the preceding aspects, and the at least one first cooling passage includes a plurality of first cooling passages and the at least one second cooling passage includes a plurality of second cooling passages, and wherein the plurality of first cooling passages alternates with the plurality of second cooling passages radially along the leading edge of the airfoil.

Another aspect of the disclosure includes any of the preceding aspects, and at least one of: a) the plurality of first film cooling holes include a portion having a smaller cross-sectional area than the at least one first cooling passage, creating a back pressure in the first plenum and the at least one first cooling passage; and b) the plurality of second film cooling holes include a portion having a smaller cross-sectional area than the at least one second cooling passage, creating a back pressure in the second plenum and the at least one second cooling passage.

Another aspect of the disclosure includes any of the preceding aspects, and the at least one first cooling passage and the at least one second cooling passage each have an average cross-sectional area of no greater than 0.1 square millimeters.

Another aspect of the disclosure includes any of the preceding aspects, and the first coolant source and the second coolant source are fluidly separated in the body by a separation wall.

Another aspect of the disclosure includes any of the preceding aspects, and at least one of: a) at least one of the plurality of first film cooling holes is at different radial position in the body from the at least one first cooling passage, and b) at least one of the plurality of second film cooling holes is at a different radial position in the body from the at least one second cooling passage.

Another aspect of the disclosure includes any of the preceding aspects, and at least one of: a) the plurality of first film cooling holes includes a different number of cooling holes than a number of the at least one first cooling passage, and b) the plurality of second film cooling holes includes a different number of cooling holes than a number of the at least one second cooling passage.

Another aspect of the disclosure includes any of the preceding aspects, and at least one of the first plenum and the second plenum have an inconsistent cross-sectional area.

Another aspect of the disclosure includes any of the preceding aspects, and the body is coupled to a radially inner platform at a radially inner end thereof, and to a radially outer platform at a radially outer end thereof, forming a turbine nozzle.

Another aspect of the disclosure includes a turbine nozzle, comprising: an airfoil body including a wall defining a pressure side, a suction side and a leading edge extending between the pressure side and the suction side; a radially inner platform coupled to the airfoil body at a radially inner end thereof, and a radially outer platform coupled to the airfoil body at a radially outer end thereof; and a cooling circuit inside the wall of the body, the cooling circuit including at least one of: a) a suction side to pressure side cooling sub-circuit including at least one first cooling passage extending inside the wall of the body from the suction side to the pressure side around the leading edge to a first plenum defined in the wall on the pressure side, and a plurality of first film cooling holes in fluid communication with the first plenum and extending through the wall on the pressure side, wherein a first coolant from a first coolant source flows in the at least one first cooling passage and the first plenum and exits through the plurality of first film cooling holes; and b) a pressure side to suction side cooling sub-circuit including at least one second cooling passage extending inside the wall of the body from the pressure side to the suction side around the leading edge to a second plenum defined in the wall on the suction side, and a plurality of second film cooling holes in fluid communication with the second plenum and extending through the wall on the suction side, wherein a second coolant from a second coolant source flows in the at least one second cooling passage and the second plenum and exits through the plurality of second film cooling holes.

Another aspect of the disclosure includes any of the preceding aspects, and the cooling circuit includes both the pressure side to suction side cooling sub-circuit, and the suction side to pressure side cooling sub-circuit, and wherein the at least one first cooling passage includes a plurality of first cooling passages and the at least one second cooling passage includes a plurality of second cooling passages, and wherein the plurality of first cooling passages alternates with the plurality of second cooling passages radially along the leading edge of the airfoil.

Another aspect of the disclosure includes any of the preceding aspects, and at least one of: a) the plurality of first film cooling holes include a portion having a smaller cross-sectional area than the at least one first cooling passage, creating a back pressure in the first plenum and the at least one first cooling passage; and b) the plurality of second film cooling holes include a portion having a smaller cross-sectional area than the at least one second cooling passage, creating a back pressure in the second plenum and the at least one second cooling passage.

Another aspect of the disclosure includes any of the preceding aspects, and the first coolant source and the second coolant source are fluidly separated in the body by a separation wall.

Another aspect of the disclosure includes any of the preceding aspects, and at least one of: a) at least one of the plurality of first film cooling holes is at different radial position in the airfoil body from the at least one first cooling passage, and b) at least one of the plurality of second film cooling holes is at a different radial position in the airfoil body from the at least one second cooling passage.

Another aspect of the disclosure includes any of the preceding aspects, and at least one of: a) the plurality of first film cooling holes includes a different number of cooling holes than a number of the at least one first cooling passage, and b) the plurality of second film cooling holes includes a different number of cooling holes than a number of the at least one second cooling passage.

Another aspect of the disclosure includes any of the preceding aspects, and at least one of the first plenum and the second plenum have an inconsistent cross-sectional area.

An aspect of the disclosure includes a method of cooling a turbine airfoil, the method comprising: in the turbine airfoil including a body including a wall defining a pressure side, a suction side, and a leading edge extending between the pressure side and the suction side, performing at least one of: a) inside at least one first cooling passage, flowing a first coolant from a first coolant source in the suction side around the leading edge to a first plenum and then to a plurality of first film cooling holes through the wall on the pressure side; and b) inside at least one second cooling passage, flowing a second coolant from a second coolant source from the pressure side around the leading edge to a second plenum and then to a plurality of second film cooling holes through the wall on the suction side.

Another aspect of the disclosure includes any of the preceding aspects, and the performing includes performing both a) and b), and wherein the at least one first cooling passage includes a plurality of first cooling passages and the at least one second cooling passage includes a plurality of second cooling passages, and wherein the plurality of first cooling passages alternates with the plurality of second cooling passages radially along the leading edge of the airfoil.

Another aspect of the disclosure includes any of the preceding aspects, and further comprising creating a back pressure in at least one of: a) the first plenum and the at least one first cooling passage by providing at least one of the plurality of first film cooling holes with a portion having a smaller cross-sectional area than the at least one first cooling passage; and b) the second plenum and the at least one second cooling passage by providing at least one of the plurality of second film cooling holes with a portion having a smaller cross-sectional area than the at least one second cooling passage.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
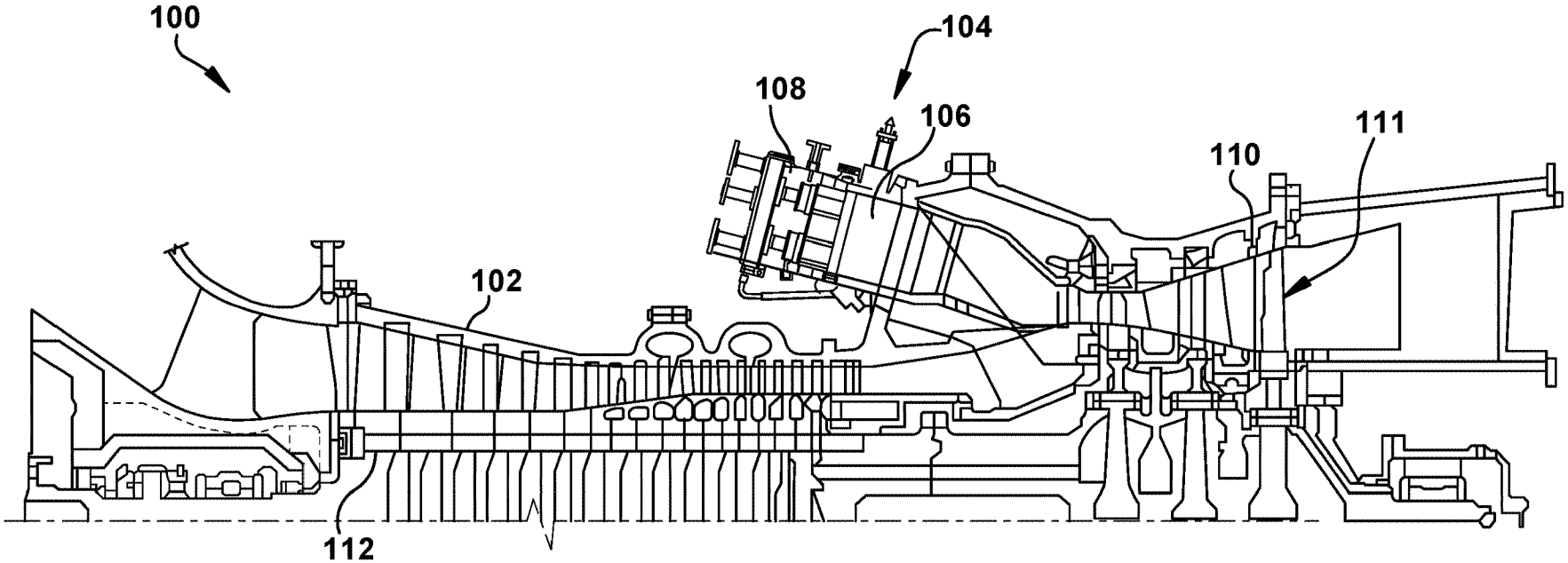
FIG. 1 (PRIOR ART)
FIG. 1 shows a simplified cross-sectional view of an illustrative turbomachine in the form of a gas turbine system.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within a turbomachine. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through the turbine engine or, for example, the flow of air through the combustor or coolant through one of the turbine's component systems. The term "downstream" corresponds to the direction of flow of the fluid, and the term "upstream" refers to the direction opposite to the flow (i.e., the direction from which the flow originates). The terms "forward" and "aft," without any further specificity, refer to directions, with "forward" referring to the front or compressor end of the engine, and "aft" referring to the rearward section of the turbomachine.

It is often required to describe parts that are disposed at different radial positions with regard to a center axis. The term "radial" refers to movement or position perpendicular to an axis. For example, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. The term "axial" refers to movement or position parallel to an axis, e.g., of a turbine. Finally, the term "circumferential" refers to movement or position around an axis. It will be appreciated that such terms may be applied in relation to the center axis of the turbomachine.

In addition, several descriptive terms may be used regularly herein, as described below. The terms "first," "second," and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently described component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, no intervening elements or layers are present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As indicated above, the disclosure provides a turbine airfoil including a body including a wall defining a pressure side, a suction side, and a leading edge extending between the pressure side and the suction side. A cooling circuit inside the wall of the body may include a suction side to pressure side (SS-to-PS) cooling sub-circuit including at least one first cooling passage extending inside the wall of the body from the suction side to the pressure side around the leading edge to a first plenum defined in the wall on the pressure side. The SS-to-PS cooling sub-circuit may also include a plurality of first film cooling holes in fluid communication with the first plenum and extending through the wall on the pressure side. A first coolant from a first coolant source flows in the first cooling passage(s) and into the first plenum and exits through the plurality of first film cooling holes.

Alternatively to the SS-to-PS cooling sub-circuit, or in addition thereto, the cooling circuit may include a pressure side to suction side (PS-to-SS) cooling sub-circuit including at least one second cooling passage extending inside the wall of the body from the pressure side to the suction side around the leading edge to a second plenum defined in the wall on the suction side. The PS-to-SS cooling sub-circuit may also include a plurality of second film cooling holes in fluid communication with the second plenum and extending through the wall on the pressure side. A second coolant from a second coolant source flows in the at least one second cooling passage and into the second plenum and exits through the plurality of second film cooling holes. A turbine nozzle including the airfoil, and a related method for cooling an airfoil, are also provided.

The cooling passages communicating coolant, perhaps in opposing directions, reduces the amount of coolant required to cool the leading edge because the coolant absorbs more heat along the relatively longer cooling passages. In addition, since the cooling passages pass coolant around the leading edge of the airfoil, the coolant can be exhausted through shaped film cooling holes that provide better film coverage and that achieve cooling further downstream from the leading edge. The plenums provide a fluid coupling between the cooling passages and the film cooling holes, thereby preventing ingestion of a working fluid where an opening arises in the leading edge.

FIG. 1 shows a schematic illustration of an illustrative industrial machine, turbine airfoils of which may include a cooling circuit according to teachings of the disclosure. In the example, the machine includes a turbomachine 100 in the form of a combustion or gas turbine system. Turbomachine 100 includes a compressor 102 and a combustor 104. Combustor 104 includes a combustion region 106 and a fuel nozzle assembly 108. Turbomachine 100 also includes a turbine 110 (i.e., an "expansion turbine") and a common compressor/turbine shaft 112 (sometimes referred to as a rotor 112).

In one embodiment, turbomachine 100 is a 7HA.03 engine, commercially available from General Electric Company, Greenville, S.C. The present disclosure is not limited to any one particular GT system and may be implemented in connection with other engines including, for example, the other HA, F, B, LM, GT, TM and E-class engine models of General Electric Company, and engine models of other companies. The present disclosure is not limited to any particular turbine or turbomachine, and may be applicable to turbine airfoils in, for example, steam turbines, jet engines, compressors, turbofans, etc.

In operation, air flows through compressor 102, and compressed air is supplied to combustor 104. Specifically, the compressed air is supplied to fuel nozzle assembly 108 that is integral to combustor 104. Assembly 108 is in flow communication with combustion region 106. Fuel nozzle assembly 108 is also in flow communication with a fuel source (not shown) and channels fuel and air to combustion region 106. Combustor 104 ignites and combusts fuel to produce a gas stream of combustion products. Combustor 104 is in flow communication with turbine assembly 110 in which gas stream thermal energy is converted to mechanical rotational energy. Turbine assembly 110 includes a turbine 111 that rotatably couples to and drives rotor 112. Compressor 102 also is rotatably coupled to rotor 112. In the illustrative embodiment, there are multiple combustors 104 and fuel nozzle assemblies 108.

Figure 2:
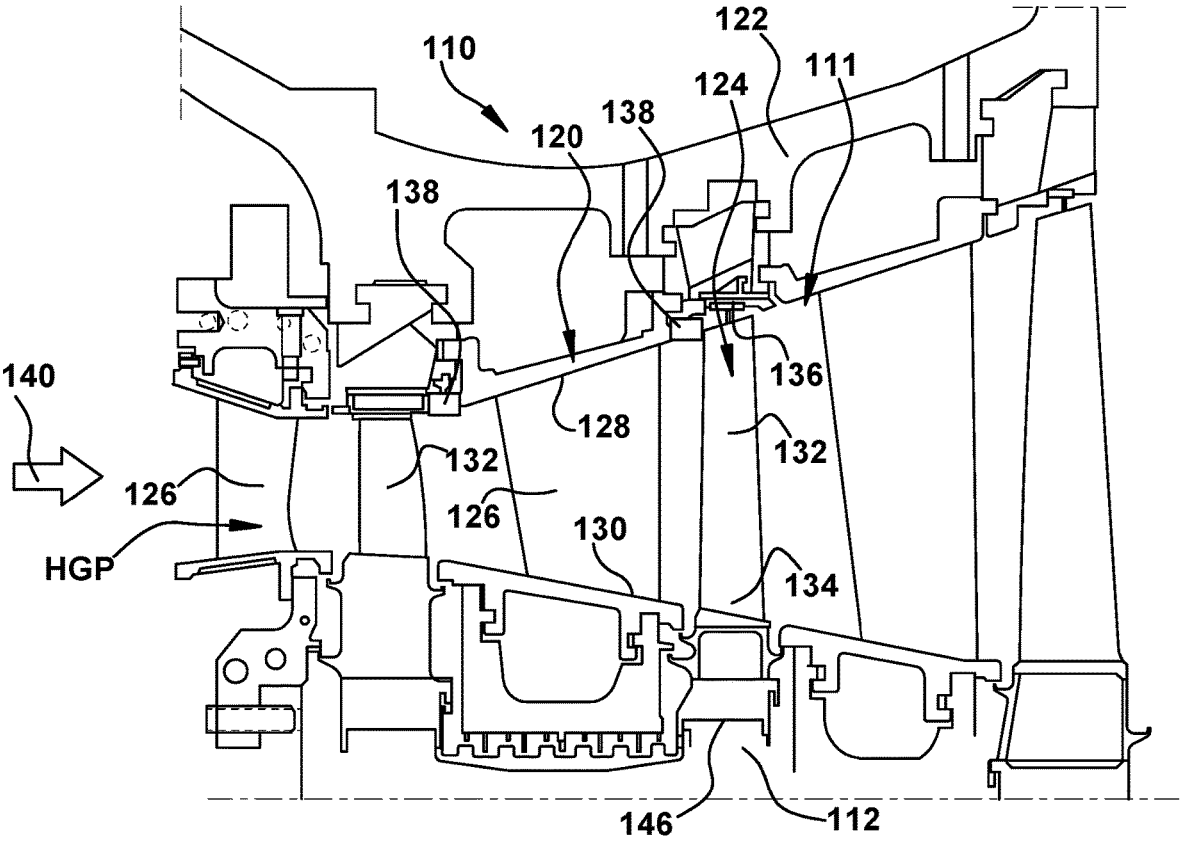
FIG. 2 (PRIOR ART)
FIG. 2 shows a cross-sectional view of an illustrative turbine section that may be used with the gas turbine system in FIG. 1.

FIG. 2 shows a cross-sectional view of an illustrative turbine assembly 110 of turbomachine 100 (FIG. 1) that may be used with the gas turbine system in FIG. 1. Turbine 111 of turbine assembly 110 includes a row or stage of nozzles 120 coupled to a stationary casing 122 of turbomachine 100 and axially adjacent a row or stage of rotating blades 124. A nozzle 126 (also known as a vane) may be held in turbine assembly 110 by a radially outer platform 128 and a radially inner platform 130. Each stage of blades 124 in turbine assembly 110 includes rotating blades 132 coupled to rotor 112 and rotating with the rotor. Rotating blades 132 may include a radially inner platform 134 (at root of blade) coupled to rotor 112 and a radially outer tip 136 (at tip of blade). Shrouds 138 may separate adjacent stages of nozzles 126 and rotating blades 132. A working fluid 140, including for example combustion gases in the example gas turbine, passes through turbine 111 along what is referred to as a hot gas path (hereafter simply "HGP"). The HGP can be any area of turbine 111 exposed to hot temperatures. In the example turbine 111, nozzles 126 and blades 132, including their respective airfoils, are examples of turbine components that may benefit from the teachings of the disclosure.

Figure 3:
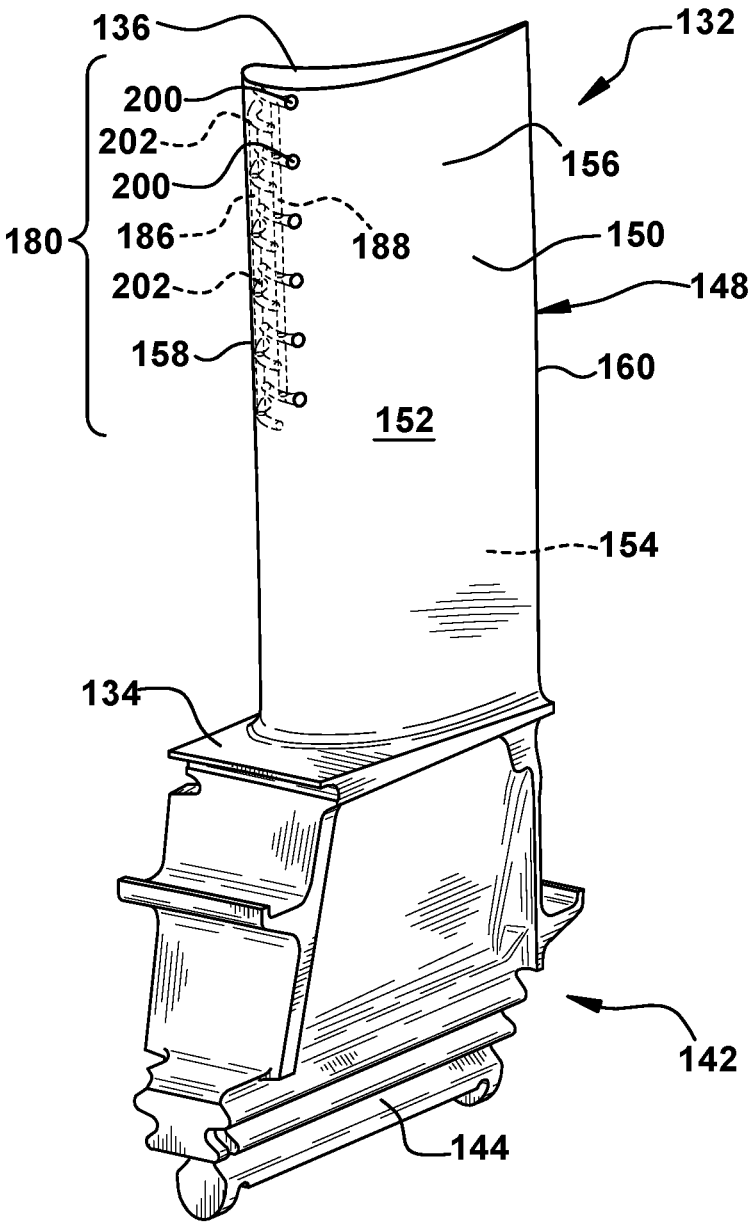
FIG. 3 shows a side perspective view of a turbine rotating blade of the type in which embodiments of the disclosure may be employed.
Figure 4:
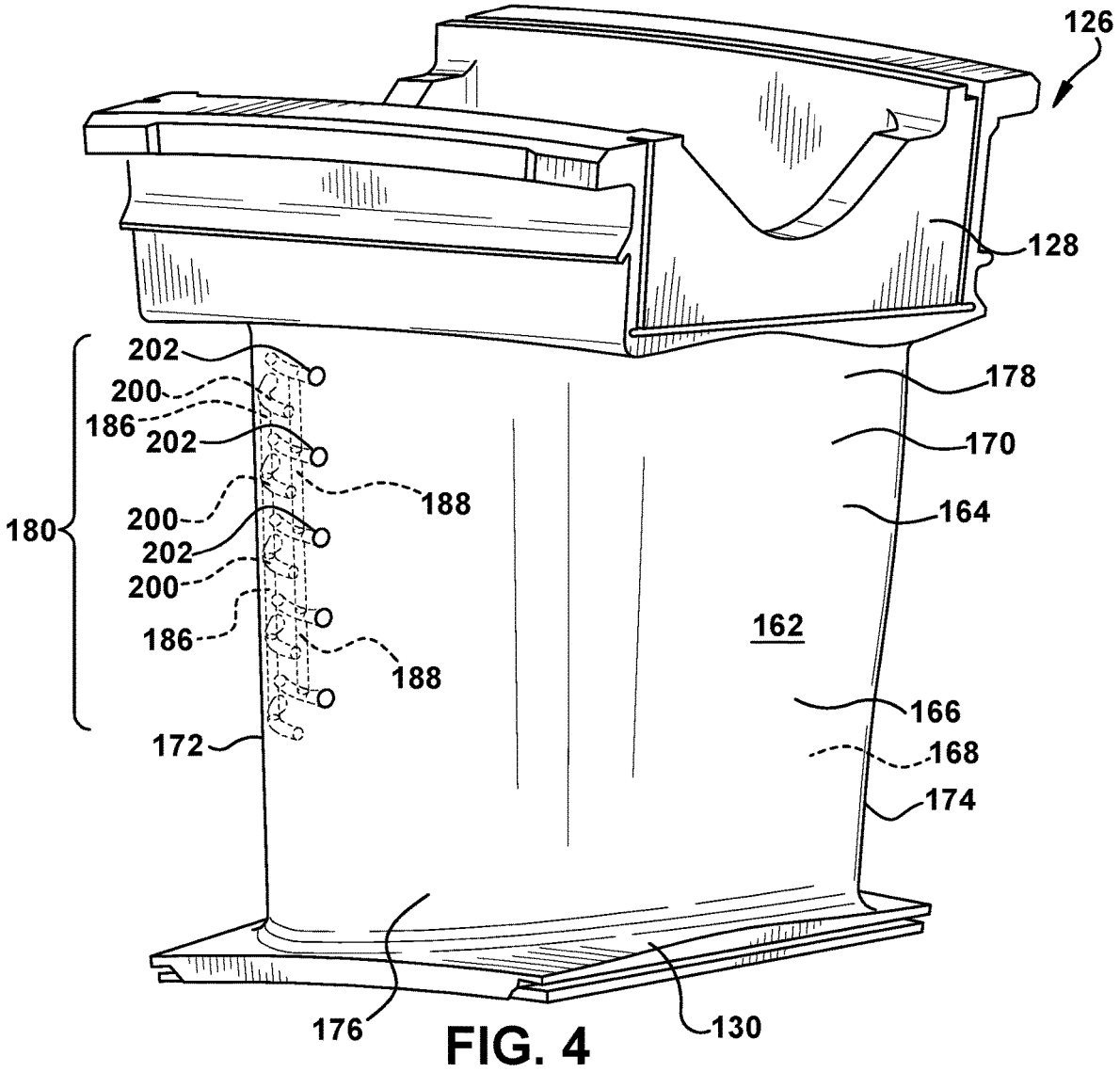
FIG. 4 shows a side perspective view of a turbine nozzle of the type in which embodiments of the disclosure may be employed.

FIGS. 3-4 show side perspective views of example turbine components including airfoils in which teachings of the disclosure may be employed.

FIG. 3 shows a side perspective view of a turbine rotating blade 132 of the type in which embodiments of the disclosure may be employed. Turbine rotating blade 132 includes a root 142 by which rotating blade 132 attaches to rotor 112 (FIG. 2). Root 142 may include a dovetail 144 configured for mounting in a corresponding dovetail slot in the perimeter of a rotor wheel 146 (FIG. 2) of rotor 112 (FIG. 2). It will be appreciated that airfoil 152 is the active component of rotating blade 132 that intercepts the flow of working fluid and induces rotor wheel 146 to rotate.

It will be seen that airfoil 152 of rotating blade 132 includes a body 148 including a wall 150 defining a pressure side 154, a suction side 156, and a leading edge 158 and a trailing edge 160 extending between pressure side 154 and suction side 156. More specifically, pressure side 154 includes a concave pressure side (PS) wall, and suction side 156 includes a circumferentially or laterally opposite convex suction side (SS) wall extending axially between opposite leading and trailing edges 158, 160 respectively. Sides 154 and 156 also extend in the radial direction from platform 134 to radial outer tip 136. Tip 136 may include any now known or later developed tip shroud (not shown). A cooling circuit 180 including sub-circuits 182, 184 including passages 200, 202, respectively, according to embodiments of the disclosure and described in greater detail herein, can be used, for example, within airfoil 152 of rotating blade 132 and, more particularly, within leading edge 158 thereof.

FIG. 4 shows a side perspective view of a stationary nozzle 126 of the type in which embodiments of the disclosure may be employed. Stationary nozzle 126 includes radial outer platform 128 by which stationary nozzle 126 attaches to stationary casing 122 (FIG. 2) of the turbomachine. Outer platform 128 may include any now known or later developed mounting configuration for mounting in a corresponding mount in the casing. Stationary nozzle 126 may further include radially inner platform 130 for positioning between adjacent turbine rotating blades 132 (FIG. 2) and (airfoil) platforms 134 (FIG. 2). Platforms 128, 130 define respective portions of the outboard and inboard boundary of the HGP (FIG. 2) through turbine assembly 110 (FIG. 2).

It will be appreciated that an airfoil 162 is the active component of stationary nozzle 126 that intercepts the flow of working fluid and directs it towards turbine rotating blades 132 (FIG. 3). It will be seen that airfoil 162 of stationary nozzle 126 includes a body 164 including a wall 166 defining a pressure side 168, a suction side 170, and a leading edge 172 and a trailing edge 174 extending between pressure side 168 and suction side 170. More particularly, pressure side 168 includes a concave pressure side (PS) outer wall, and suction side 170 includes a circumferentially or laterally opposite convex suction side (SS) outer wall extending axially between opposite leading and trailing edges 172, 174 respectively. Pressure side 168 and suction side 170 also extend in the radial direction from platform 128 to platform 130. Body 164 of airfoil 162 is coupled to radially inner platform 130 at a radially inner end 176 thereof, and to radially outer platform 128 at a radially outer end 178 thereof, forming turbine nozzle 126. A cooling circuit 180 including sub-circuits 182, 184 including passages 200, 202, respectively, according to embodiments of the disclosure and described in greater detail herein, can be used, for example, within airfoil 162 of stationary nozzle 126 and, more particularly, within leading edge 172 thereof.

Leading edges 158, 172 of airfoils 152, 162, respectively, are identified as a forwardmost edge of the airfoils, and where the curvature peaks between the respective pressure and suction sides of each airfoil.

Figure 5A:
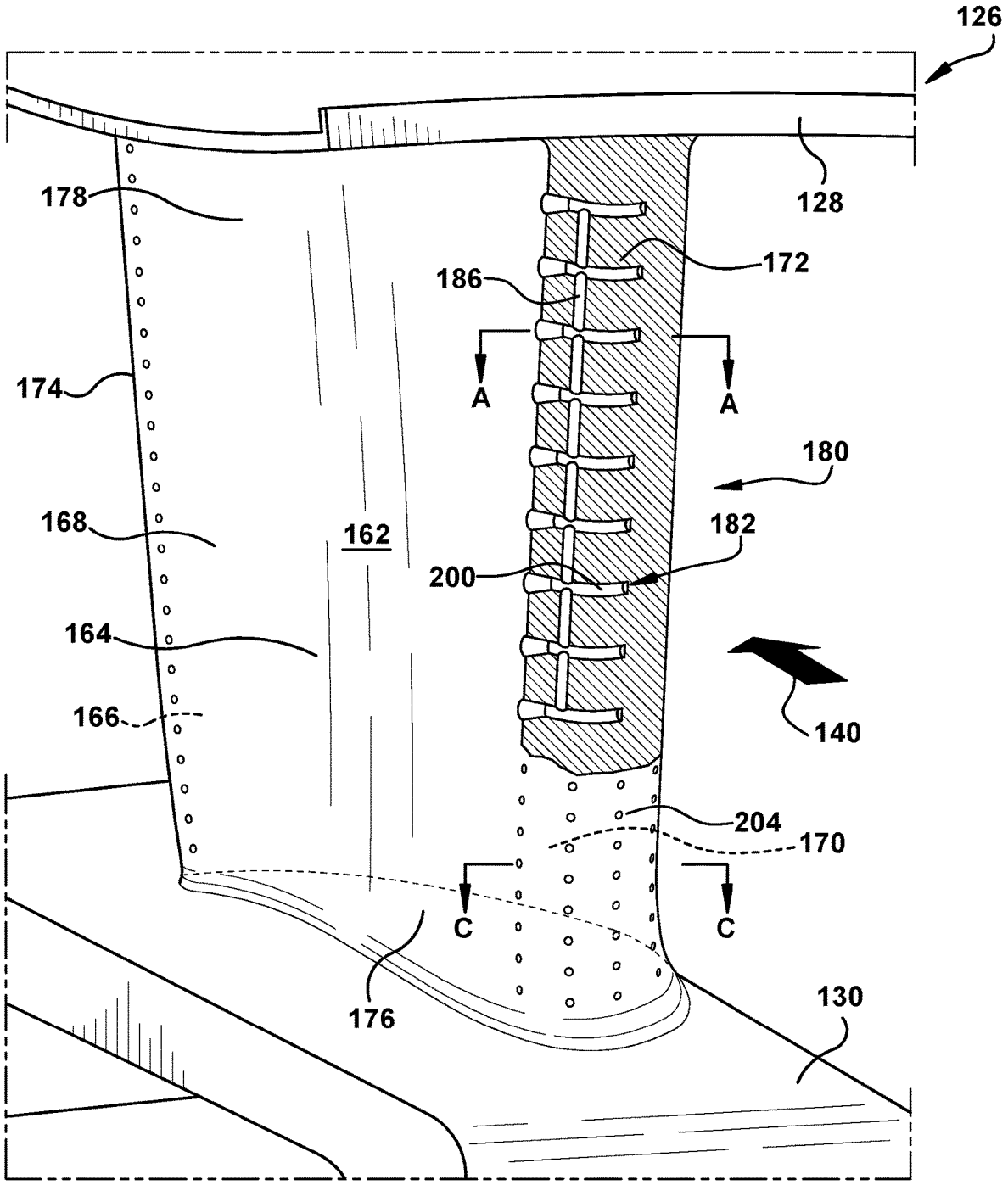
FIG. 5A shows a front perspective view of a turbine nozzle of the type in which embodiments of the disclosure may be employed and including a first cooling sub-circuit.
Figure 5B:
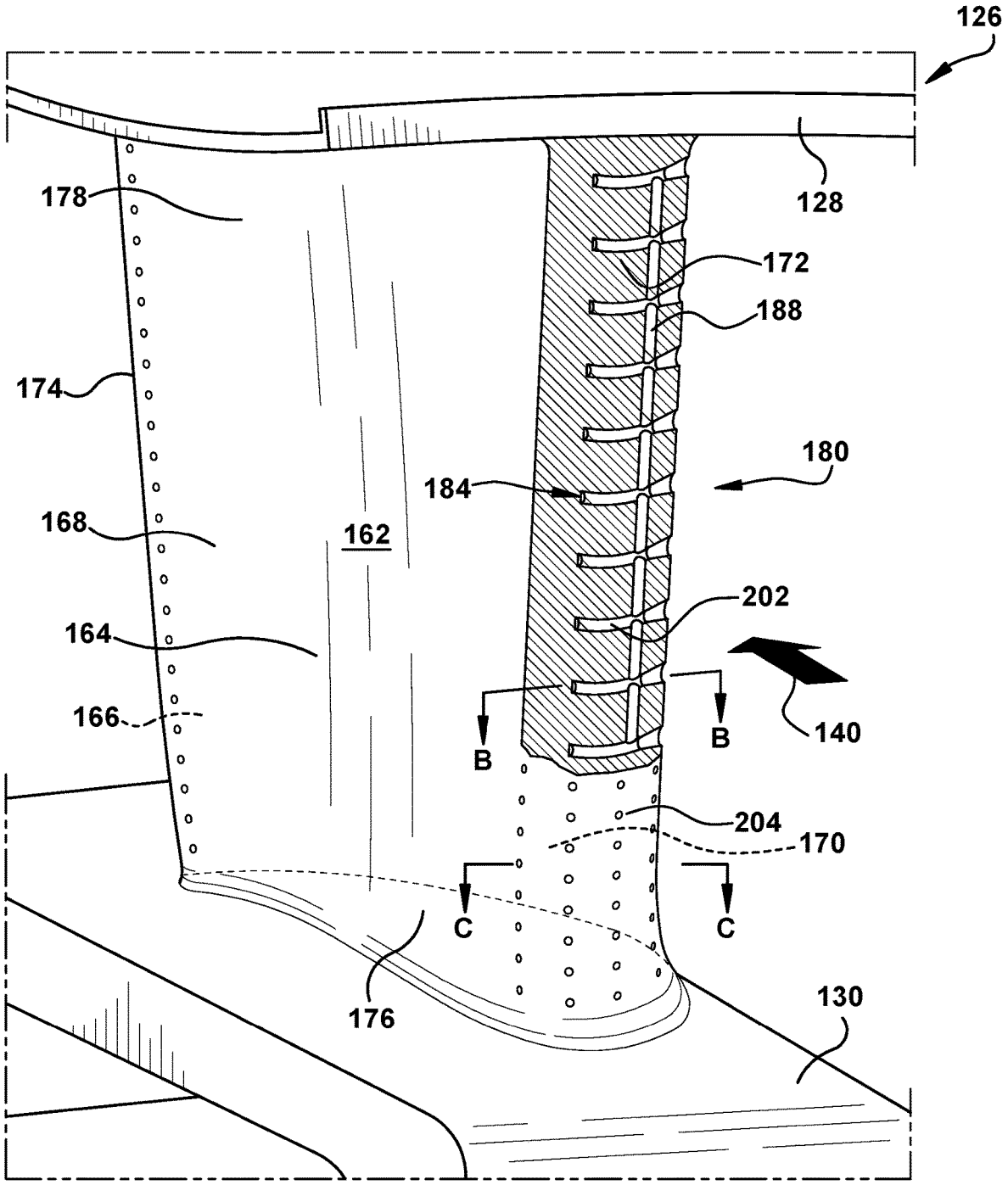
FIG. 5B shows a front perspective view of a turbine nozzle of the type in which embodiments of the disclosure may be employed and including a second cooling sub-circuit.
Figure 5C:
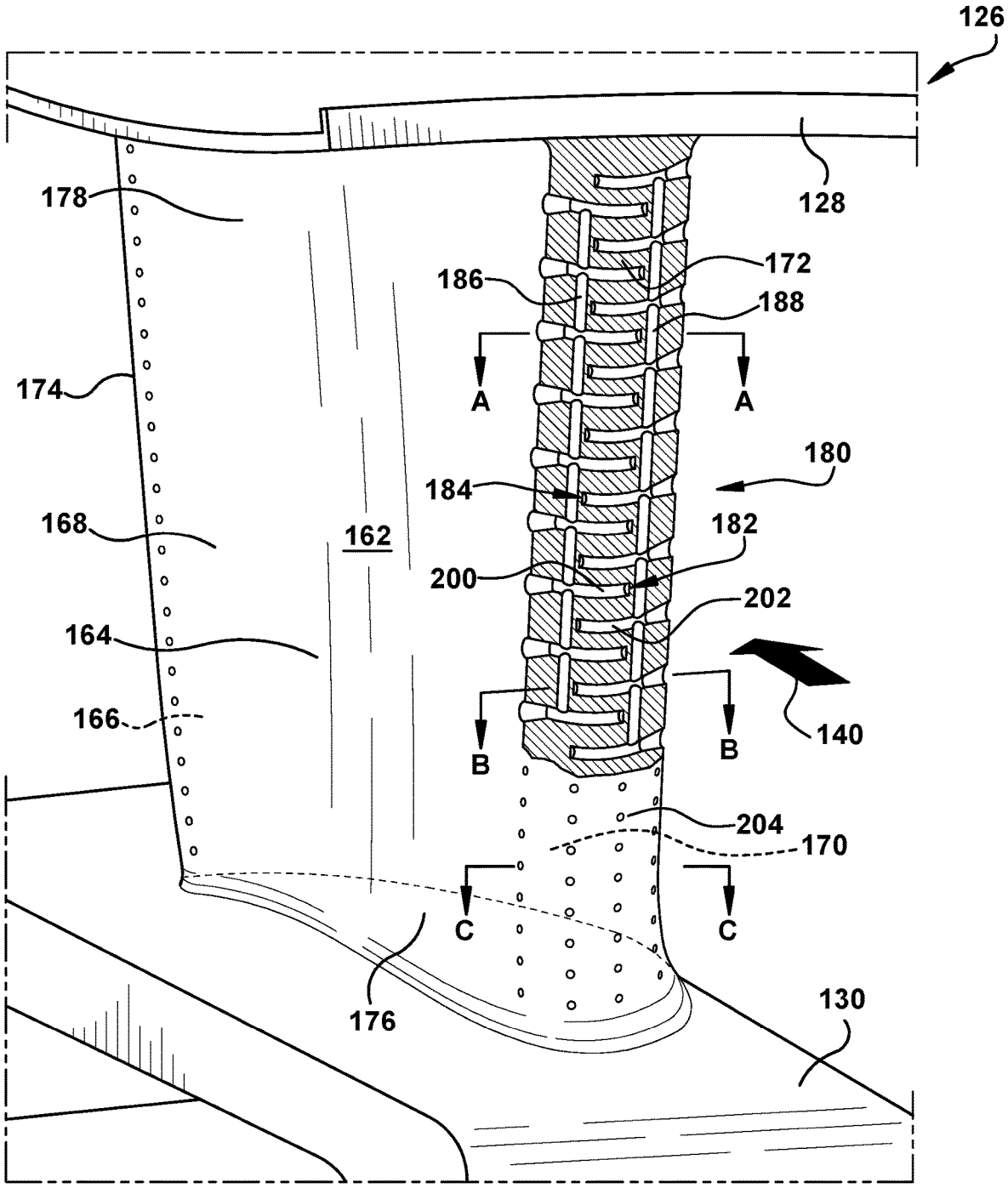
FIG. 5C shows a front perspective view of a turbine nozzle of the type in which embodiments of the disclosure may be employed and including both the first and second cooling sub-circuits.
Figure 6:
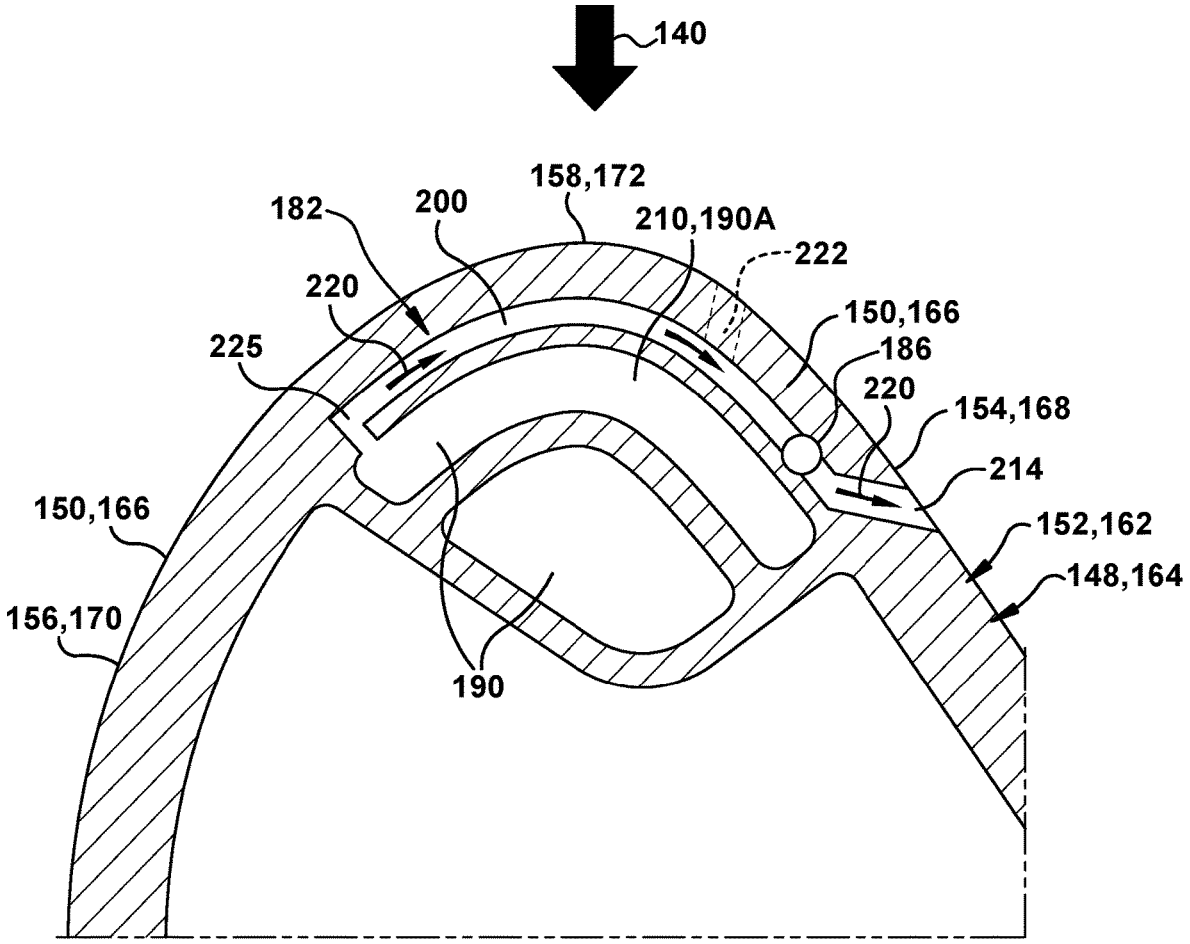
FIG. 6 shows a cross-sectional view of a turbine airfoil through a first cooling passage along view line A-A in FIGS. 5A and 5C, according to embodiments of the disclosure.
Figure 7:
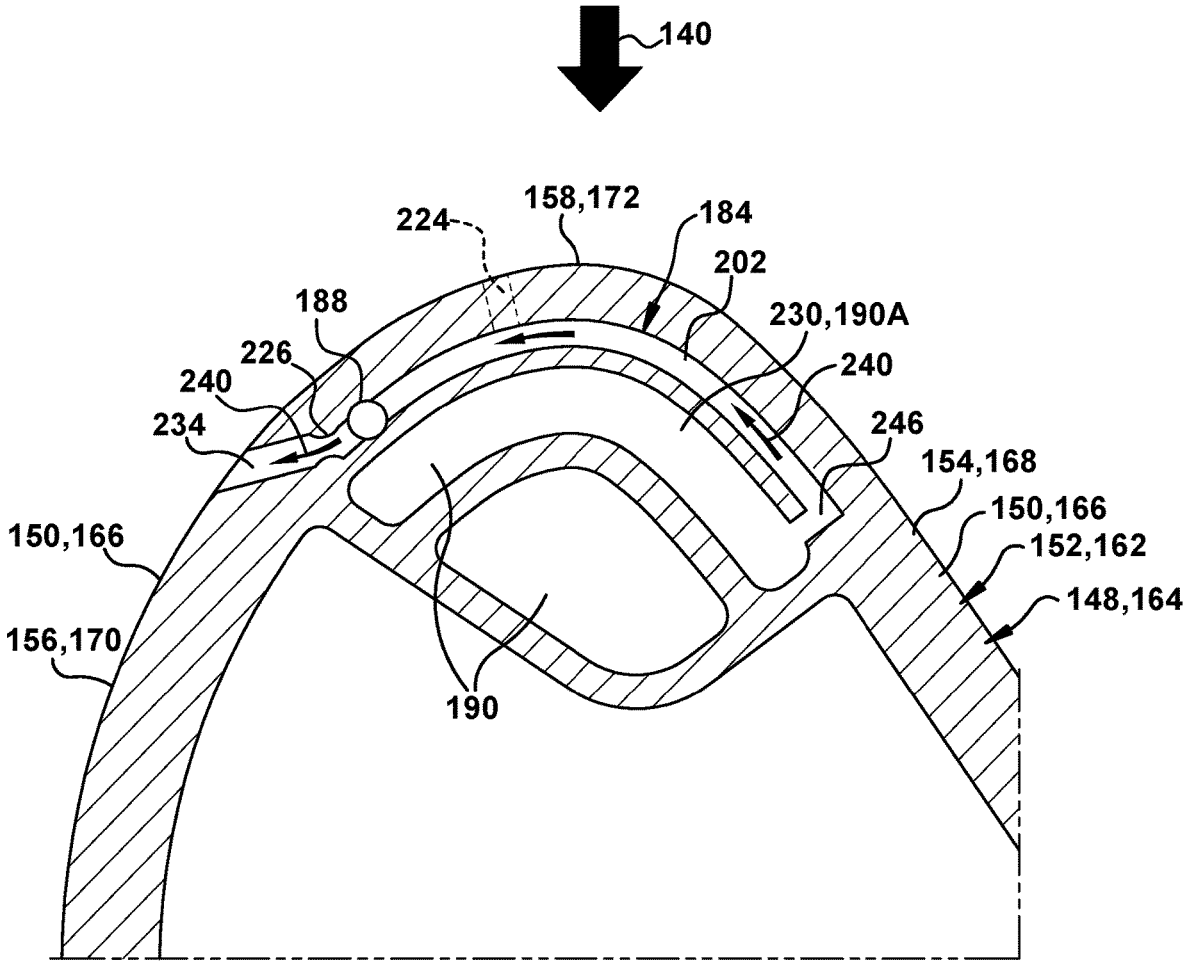
FIG. 7 shows a cross-sectional view of a turbine airfoil through a second cooling passage along view line B-B in FIGS. 5B and 5C, according to embodiments of the disclosure.

FIGS. 5A-5C show front perspective views of an illustrative airfoil for a nozzle 126 including turbine airfoil 162 and various embodiments of a cooling circuit 180. Cooling circuit 180 may include a suction side to pressure side cooling sub-circuit 182 (FIGS. 5A and 5C, hereafter "SS-to-PS sub-circuit 182" for brevity), a pressure side to suction side cooling sub-circuit 184 (FIGS. 5B and 5C, hereafter "PS-to-SS sub-circuit 184" for brevity), or both (FIG. 5C). FIG. 6 shows a cross-sectional view of turbine airfoil 162 through SS-to-PS sub-circuit 182 and a cooling passage 200 thereof along view line A-A in FIGS. 5A and 5C, and FIG. 7 shows a cross-sectional view of turbine airfoil 162 through PS-to-SS sub-circuit 184 and a cooling passage 202 thereof along view line B-B in FIGS. 5B and 5C, according to certain embodiments of the disclosure.

Referring to FIGS. 3-7, as noted, embodiments of the disclosure may include a turbine airfoil 152 (FIG. 3) or turbine airfoil 162 (FIGS. 4-5C) such as those employed for turbine rotating blades 132 (FIGS. 2 and 3) or stationary nozzles 126 (FIGS. 4-5C), respectively. Turbine airfoils 152, 162 may include a coolant supply chamber(s) 190 (see e.g., FIGS. 6-7) to deliver coolant to parts thereof to cool those parts. Coolant supply chamber(s) 190 in airfoils 152, 162 may be used as coolant sources 210, 230 (FIGS. 6-9) for cooling sub-circuits 182, 184 and cooling passages 200, 202, respectively, according to embodiments of the disclosure.

For purposes of description, cross-sectional views of cooling sub-circuits 182, 184 and cooling passages 200, 202 in FIGS. 6-9 are illustrated with internal coolant supply chamber(s) 190 appropriate for airfoil 162 for nozzle 126. However, the cross-sectional views of FIGS. 6-9 also include reference numerals to airfoil 152 for blade 132. It will be understood that coolant supply chamber(s) 190 for airfoil 152 for a blade 132 (FIG. 3) may be different in, for example, number, shape, position and/or arrangement, from that shown for nozzle 126 (FIGS. 4-5C) depending, for example, on their respective cooling requirements. It is also emphasized that while coolant supply chamber(s) 190 (FIGS. 6-9) are illustrated as extending primarily radially in airfoils 152, 162, they may extend in any direction within body 148, 164 of airfoils 152, 162, respectively. In any event, it is emphasized that the teachings of the disclosure may be applied to any turbine airfoil 152, 162 having any coolant supply chamber(s) 190 therein that act as coolant source(s) 210, 230 for cooling sub-circuits 182, 184 and related cooling passages 200, 202 thereof.

Referring to FIG. 3, turbine airfoil 152 for blade 132 includes body 148 including wall 150 defining pressure side 154, suction side 156, and leading edge 158 extending between pressure side 154 and suction side 156. As shown in FIGS. 4 and 5A-C, turbine airfoil 162 for nozzle 126 includes airfoil body 164 including wall 166 defining pressure side 168, suction side 170, and leading edge 172 extending between pressure side 168 and suction side 170.

As shown in the illustrative nozzle embodiments of FIGS. 5A-5C, cooling circuit 180 inside wall 166 of body 164 may include at least one of: SS-to-PS sub-circuit 182 and PS-to-SS sub-circuit 184. FIG. 5A includes only SS-to-PS sub-circuit 182 including cooling passages 200; FIG. 5B includes only PS-to-SS sub-circuit 184 including cooling passages 202; and FIG. 5C includes both SS-to-PS sub-circuit 182 and PS-to-SS sub-circuit 184 with respective cooling passages 200, 202, according to embodiments of the disclosure. The same options and arrangements shown in FIGS. 5A-5C can be employed for turbine blades 132 (FIG. 3).

As shown in FIGS. 5A, 5C, and 6, turbine airfoil 152, 162 may include SS-to-PS sub-circuit 182 including at least one first cooling passage 200 extending inside wall 150, 166 of body 148, 164 and from suction side 156, 170 around leading edge 158, 172 to a first plenum 186 defined in wall 150, 166 on pressure side 154, 168. SS-to-PS sub-circuit 182 may also include a plurality of first film cooling holes 214 in fluid communication with first plenum 186 and extending through wall 150, 166 on pressure side 154, 168. While a first film cooling hole 214 is shown at a selected location in FIG. 6, it is emphasized that first film cooling holes 214 through wall 150, 166 "on pressure side" 154, 168 may be at any location aft of leading edge 158, 172, i.e., at a stagnation line, along pressure side 154, 168 to trailing edge 160, 174 (FIGS. 3 and 4).

While wall 150, 166 is shown as a unitary structure in the cross-sectional views herein, it is understood that wall 150, 166 may include any number of layers, e.g., an internal layer, intermediate layer and/or outer layer. Passages 200, 202 may be in any layer of wall 150, 166. First coolant source 210 may be part of a coolant supply chamber 190A inside leading edge 158, 172 of airfoil 152, 162, or any other coolant supply chamber 190. In any event, a first coolant 220 (arrows) from first coolant source 210 flows in first cooling passage(s) 200 and first plenum 186 and exits through plurality of first film cooling holes 214. First coolant source 210 allows origination of first coolant 220 from suction side 156, 170 relative to leading edge 158, 172. Thus, first coolant 220 flows only from suction side 156, 170 to pressure side 154, 168 in first cooling passages 200. First coolant 220 may be any coolant used in coolant supply chamber 190A, such as air. First cooling passages 200 may fluidly couple to first coolant source 210 near a suction side end 225 thereof, i.e., to the suction side of leading edge 158, 172. First cooling passages 200 are curved and generally follow the contour of leading edge 158, 172 as they pass around leading edge 158, 172, i.e., some deviation from the leading edge contour is possible.

In SS-to-PS sub-circuit 182, first plenum 186 extends radially in body 148, 164 and connects first cooling passage(s) 200 together with plurality of first film cooling holes 214. A pressure of first coolant 220 in sub-circuit 182 is typically relatively high, e.g., higher than working fluid 140 on surface of airfoil 152, 162. In this manner, if a hole 222 (dashed lines in FIG. 6) accidentally opens somewhere along leading edge 158, 172 and exposes one or more of first cooling passages 200, first coolant 220 would exit through hole 222. Additionally, flow of first coolant 220 has sufficient pressure to prevent ingestion of working fluid 140, e.g., into cooling passage(s) 200 and/or first coolant source 210. In this manner, coolant would be provided to hole 222 but first coolant 220 would otherwise continue to flow to pressure side 154, 168. That is, first cooling passage(s) 200 not impacted by hole 222 would continue to provide first coolant 220 to pressure side 154, 168.

Figure 17:
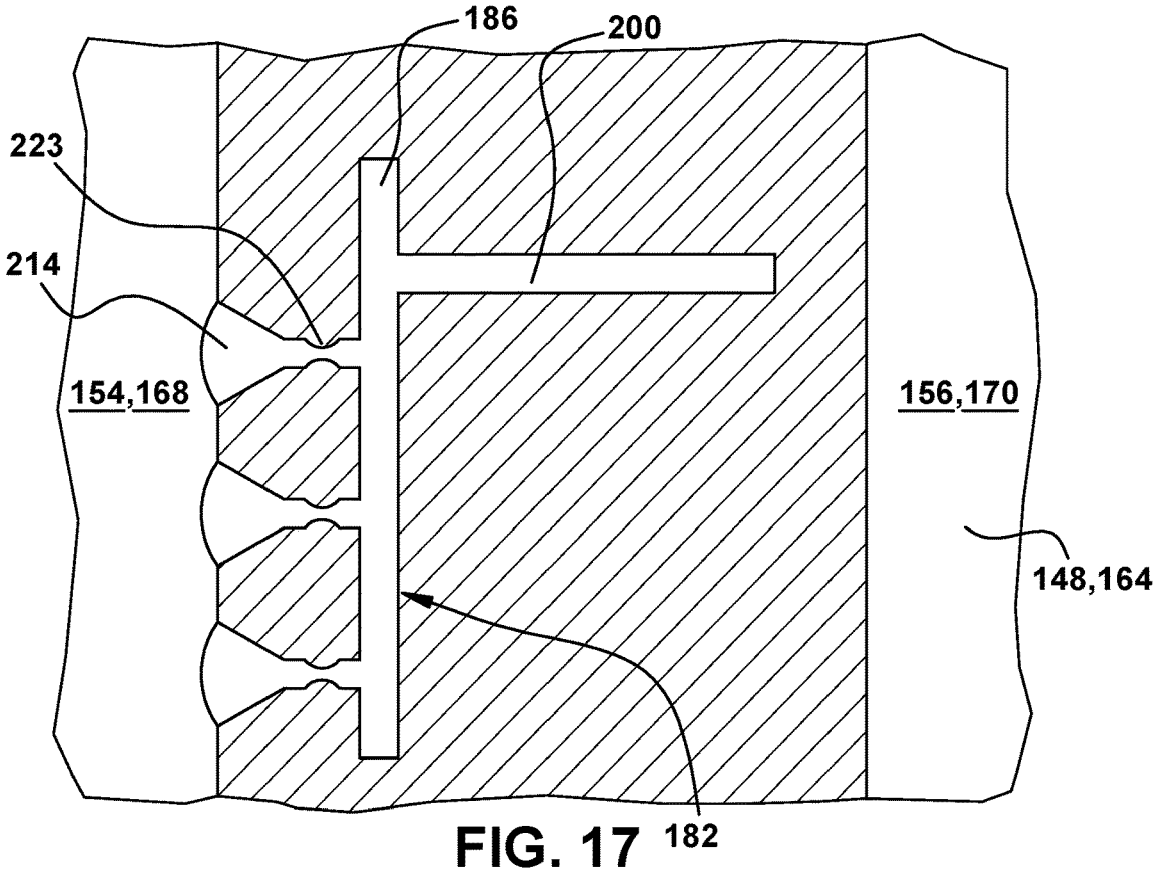
FIG. 17 shows a schematic front view of a turbine airfoil including first and second cooling passages coupled by a plenum to a plurality of film cooling holes, according to other embodiments of the disclosure.
Figure 18:
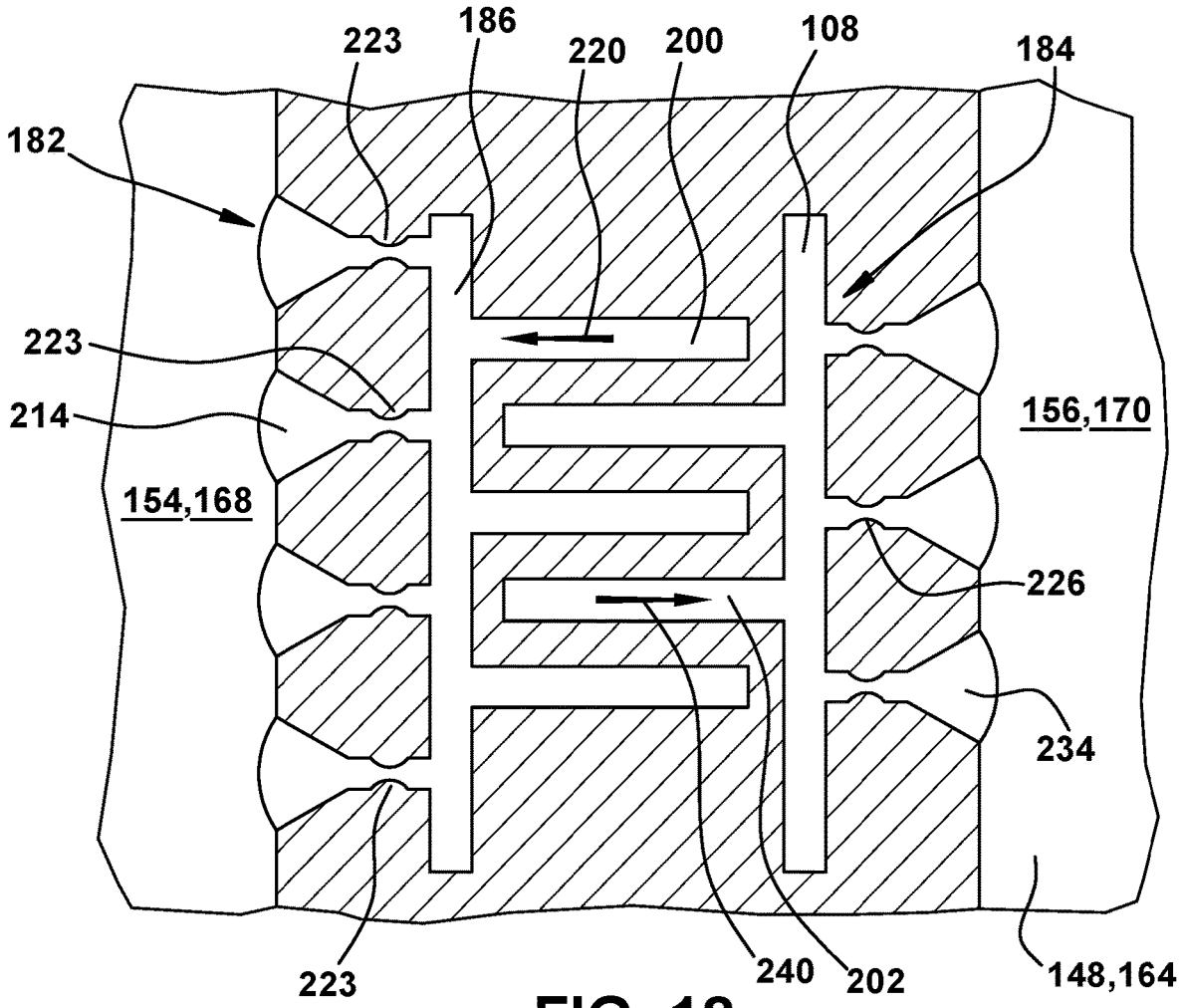
FIG. 18 shows a schematic front view of a turbine airfoil including first and second cooling passages coupled by plenums to respective pluralities of film cooling holes, according to other embodiments of the disclosure.

However, as shown in FIGS. 17 and 18, where the pressure of first coolant 220 is sufficiently low that ingestion of working fluid 140 is a concern, in an alternative embodiment, at least one of plurality of first film cooling holes 214 may include a portion 223 having a smaller cross-sectional area than each of first cooling passage(s) 200 to create a back pressure in first plenum 186 and first cooling passage(s) 200. Portion(s) 223 may include any structure that reduces a cross-sectional area of film cooling holes 214, e.g., any entry passage or structure thereof downstream of first plenum 186, to create a higher pressure upstream thereof than downstream thereof. In this manner, a pressure of first coolant 220 can be raised such that if a hole 222 (dashed lines in FIG. 6) accidentally opens somewhere along leading edge 158, 172 and exposes one or more of first cooling passages 200, working fluid 140 would not be ingested into first cooling passages 200. As explained above, first coolant 220 would exit through hole 222 and continue to pressure side 154, 168 through cooling passage(s) 200. That is, flow of first coolant 220 would have sufficient back pressure to prevent ingestion of working fluid 140, e.g., into cooling passage(s) 200 and/or first coolant source 210. First cooling passage(s) 200 not impacted by hole 222 would continue to provide first coolant 220 to pressure side 154, 168. FIG. 17 shows only first film cooling hole(s) 214 including portion 223.

As shown in FIGS. 5B, 5C, and 7, turbine airfoil 152, 162 may include PS-to-SS sub-circuit 184 including at least one second cooling passages 202 extending inside wall 150, 166 of body 148, 164 and from pressure side 154, 168 around leading edge 158, 172 to second plenum 188 defined in wall 150, 166 on suction side 156, 170. PS-to-SS sub-circuit 184 may also include a plurality of second film cooling holes 234 in fluid communication with second plenum 188 and extending through wall 150, 166 on suction side 156, 170. While a second film cooling hole 234 is shown at a selected location in FIG. 7, it is emphasized that second film cooling holes 234 through wall 150, 166 "on suction side" 156, 170 may be at any location aft of leading edge 158, 172, i.e., at a stagnation line, along suction side 156, 170 to trailing edge 160, 174 (FIGS. 3 and 4).

Second coolant source 230 may be part of coolant supply chamber 190A inside leading edge 158, 172 of airfoil 152, 162, or any other coolant supply chamber 190. In any event, a second coolant 240 (arrows) from second coolant source 230 flows in second cooling passage(s) 202 and into second plenum 188 and exits through plurality of second film cooling holes 234. Second coolant source 230 allows origination of second coolant 240 from pressure side 154, 168 relative to leading edge 158, 172. Thus, second coolant 240 flows only from pressure side 154, 168 to suction side 156, 170 in second cooling passages 202. Second coolant 240 may be any coolant used in coolant supply chamber 190A, such as air. Second cooling passage(s) 202 may fluidly couple to second coolant source 230 near a pressure side end 246 thereof. Second cooling passages 202 are curved and generally follow the contour of leading edge 158, 172 as they pass around leading edge 158, 172, i.e., some deviation from the leading edge contour is possible.

In PS-to-SS sub-circuit 184, second plenum 188 extends radially in body 148, 164 and connects second cooling passage(s) 202 together with plurality of second film cooling holes 234. The pressure of second coolant 240 in sub-circuit 184 is relatively low, e.g., at or below that of working fluid 140 on surface of airfoil 152, 162. In some circumstances, the pressure of second coolant 240 may be sufficiently high to prevent ingestion of working fluid 140 if a hole 224 (dashed lines in FIG. 7) accidentally opens somewhere along leading edge 158, 172 and exposes one or more of second cooling passages 202.

However, where the pressure of second coolant 240 is sufficiently low that ingestion of working fluid 140 is a concern, in an alternative embodiment, at least one of plurality of second film cooling holes 234 may include a portion 226 having a smaller cross-sectional area than second cooling passage(s) 202 to create a back pressure in second plenum 188 and second cooling passage(s) 202. Portion(s) 226 may include any structure that reduces a cross-sectional area of film cooling holes 234, e.g., any entry passage or structure thereof downstream of second plenum 188, to create a higher pressure upstream thereof than downstream thereof. In this manner, a pressure of second coolant 240 can be raised such that if a hole 224 (dashed lines in FIG. 7) accidentally opens somewhere along leading edge 158, 172 and exposes one or more of second cooling passages 202, working fluid 140 would not be ingested into second cooling passages 202. In such an occurrence, second coolant 240 would exit through hole 224 and continue to pressure side 154, 168 through cooling passage(s) 202. That is, flow of second coolant 240 would have sufficient back pressure to prevent ingestion of working fluid 140, e.g., into cooling passage(s) 202 and/or second coolant source 230. Second cooling passage(s) 202 not impacted by hole 224 would continue to provide second coolant 240 to suction side 156, 170. Where FIG. 7 shows only second film cooling hole(s) 234 including portion 226, FIG. 18 shows both first film cooling hole(s) 214 and second film cooling hole(s) 234 including portion(s) 223, 226 having smaller cross-sectional areas.

As shown in FIG. 5C, in another embodiment, cooling circuit 180 may include both sub-circuits 182, 184. In this embodiment, second cooling passage(s) 202 are radially spaced in turbine airfoil 152, 162 from first cooling passage(s) 200, i.e., they are not at the same radial location in airfoil(s) 152, 162. Any spacing may be employed and any arrangement of the different cooling passages 200, 202 can be used. In one example, shown in FIG. 5C, first cooling passages 200 alternate with second cooling passages 202 radially along leading edge 158, 172 of airfoil 152 (and 162).

As shown in FIGS. 3-5C, any number of cooling passages 200, 202 may be used in airfoil 152, 162. That is, first cooling passage 200 may include one or a plurality of first cooling passages 200, and second cooling passage 202 may include one or a plurality of second cooling passages 202. Where more than one of first cooling passages 200 are used or more than one of second cooling passages 202 are used, they may be radially spaced along at least a portion of airfoil 152, 162, and can be arranged in a variety of patterns to achieve a desired cooling effect. As noted, where more than one of each cooling passage 200, 202 are provided and they are used together, they may be radially spaced along at least a portion of airfoil 152, 162, and can be arranged in a variety of patterns to achieve a desired cooling effect. In one example, the plurality of first cooling passages 200 may alternate with the plurality of second cooling passages 202 radially along leading edge 158, 172 of airfoil 152, 162. Other patterns of cooling passages 200, 202 are also possible such as, but not limited to, alternating groups of two or more first and second cooling passages 200, 202.

In certain embodiments, first cooling passage(s) 200 and second cooling passage(s) 202 may be considered "micro-channels," which are relatively cross-sectionally small but longer passages. In certain embodiments, each cooling passage 200, 202 may have an average cross-sectional area of no greater than 0.1 square millimeters. Other average cross-sectional areas are also possible.

Figure 8:
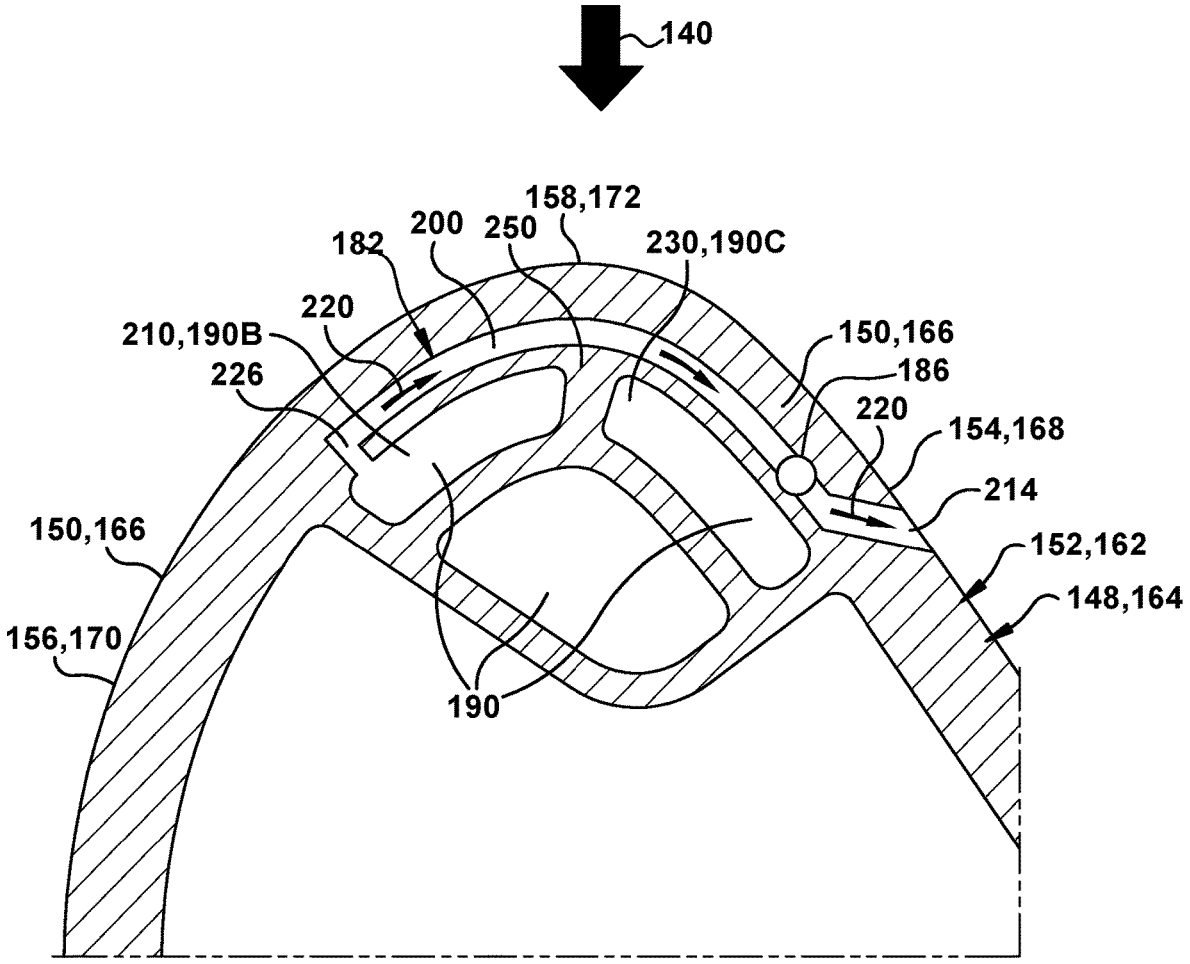
FIG. 8 shows a cross-sectional view of a turbine airfoil through a first cooling passage along view line A-A in FIGS. 5A and 5C, according to other embodiments of the disclosure.
Figure 9:
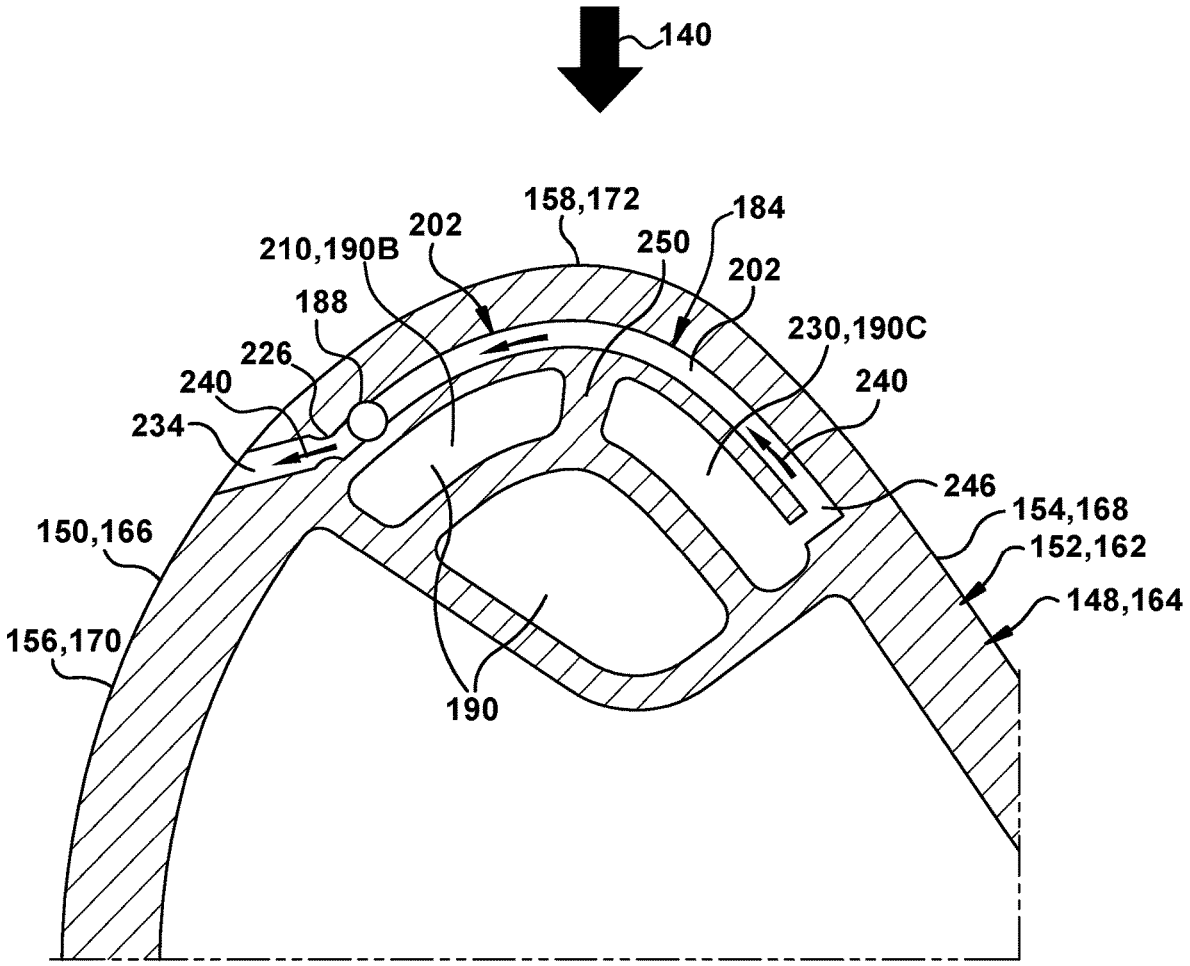
FIG. 9 shows a cross-sectional view of a turbine airfoil through a second cooling passage along view line B-B in FIGS. 5B and 5C, according to other embodiments of the disclosure.

In FIGS. 6 and 7, first coolant source 210 and second coolant source 230 are a single coolant supply chamber 190A inside body 148, 164. As noted, coolant supply chamber(s) 190 can take a variety of forms depending on the airfoil cooling requirements of the particular airfoil. FIG. 8 shows a cross-sectional view of turbine airfoil 152, 162 through cooling passage 200 along view line A-A in FIGS. 5A and 5C, according to other embodiments of the disclosure; and FIG. 9 shows a cross-sectional view of turbine airfoil 152, 162 through cooling passage 202 along view line B-B in FIGS. 5B and 5C, according to other embodiments of the disclosure. In these other embodiments, two or more coolant supply chambers 190B, 190C may be separated by an internal separation wall 250. First coolant source 210 may be its own coolant supply chamber 190B, and second coolant source 230 may be its own coolant supply chamber 190C different from coolant supply chamber 190B. In this example, first coolant source 210 is defined exclusively in suction side 156, 170 relative to leading edge 158, 172, and second coolant source 230 is defined exclusively in pressure side 154, 168 relative to leading edge 158, 172. It will be recognized that coolant supply chambers 190 that provide coolant sources 210, 230 can take a large variety of other forms that are not shown but are within the scope of the disclosure.

Figure 10:
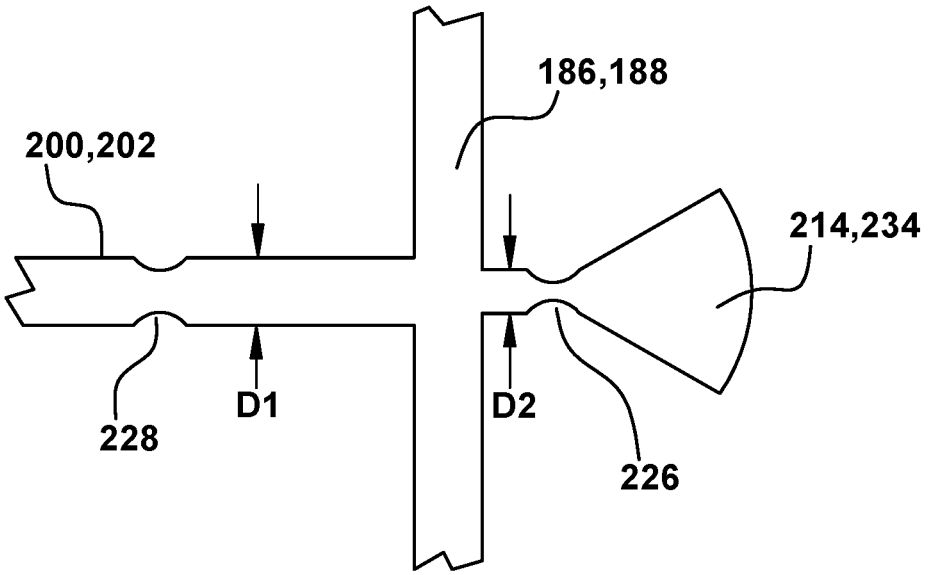
FIG. 10 shows an enlarged schematic cross-sectional view of a cooling passage, a plenum, and a film cooling hole, according to another embodiment of the disclosure.

FIG. 10 shows an enlarged schematic cross-sectional view of a cooling passage, a plenum, and a film cooling hole, according to other embodiments of the disclosure. The cross-sectional area of cooling passages 200, 202 and/or film cooling holes 214, 234 may vary along their lengths to modulate heat transfer and/or control pressure/flow through the passages. For example, cooling passages 200, 202, and film cooling holes 214, 234 (the latter upstream of their exits in wall 150, 166) may have different cross-sectional areas. In one non-limiting example, cooling passages 200, 202 may have diameter D1 along their length, and film cooling holes 214, 234 may have diameter D2 (upstream of their exits in wall 150, 166), where D1>D2. In another example, one or more cooling passages 200, 202 may include a discrete portion 228 having a smaller cross-sectional area (neck down) therein, e.g., upstream of plenum 186, 188, to provide a metering region for flow control. Other variations in cross-sectional area of cooling passages 200, 202 are also possible. In particular, as described previously, a back pressure may be created in at least one of: a) first plenum 186 and/or first cooling passage(s) 200 by providing one or more of first film cooling holes 214 with a portion 223 (see e.g., FIGS. 13, 17 and 18) having a smaller cross-sectional area than each of first cooling passage(s) 200, and b) second plenum 188 and/or second cooling passage(s) 202 by providing one or more of second film cooling holes 234 with a portion 226 (see also, e.g., FIG. 13) having a smaller cross-sectional area than each of second cooling passage(s) 202.

Figure 11:
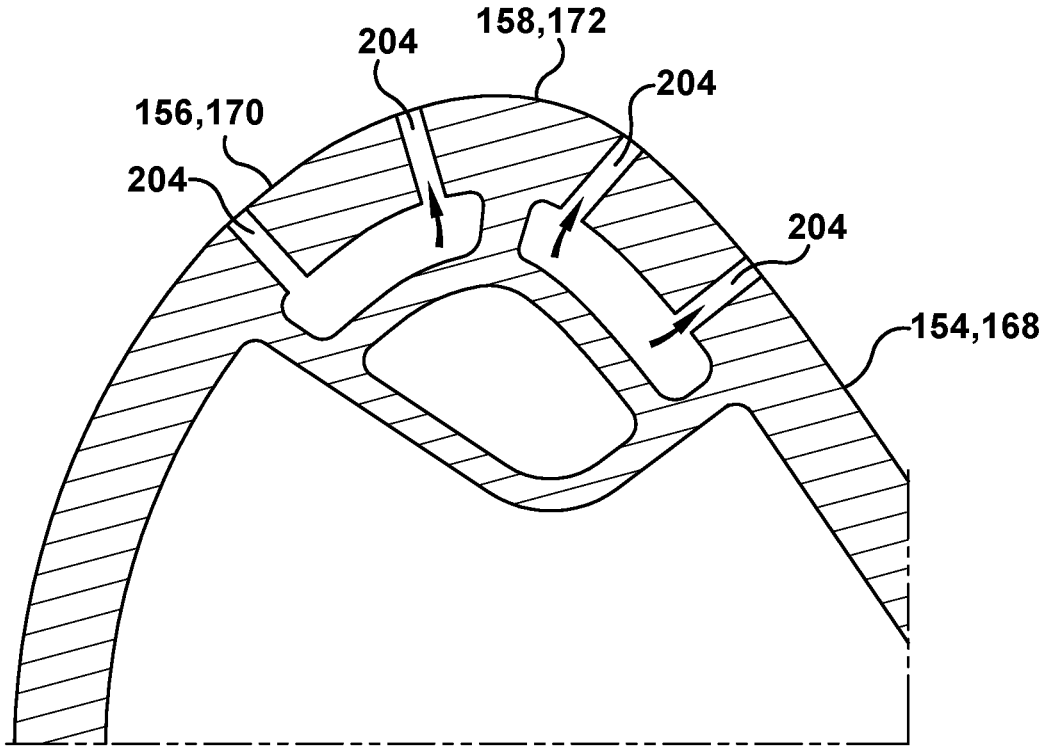
FIG. 11 shows a cross-sectional view of a turbine airfoil through a first cooling passage along view line C-C in FIGS. 5A-C, according to other embodiments of the disclosure.

FIG. 11 shows a cross-sectional view along view line C-C in FIGS. 5A-5C. Where cooling passages 200, 202 are not provided in a radial location of airfoil 152, 162, more conventional cooling systems can be employed. For example, as shown in FIG. 11, an arrangement of circular 'showerhead' or radial cooling passages 204 can be employed. Cooling passages 204 can be used in any arrangement with cooling passages 200, 202, e.g., alternating, groups of certain passages, etc.

Figure 12:
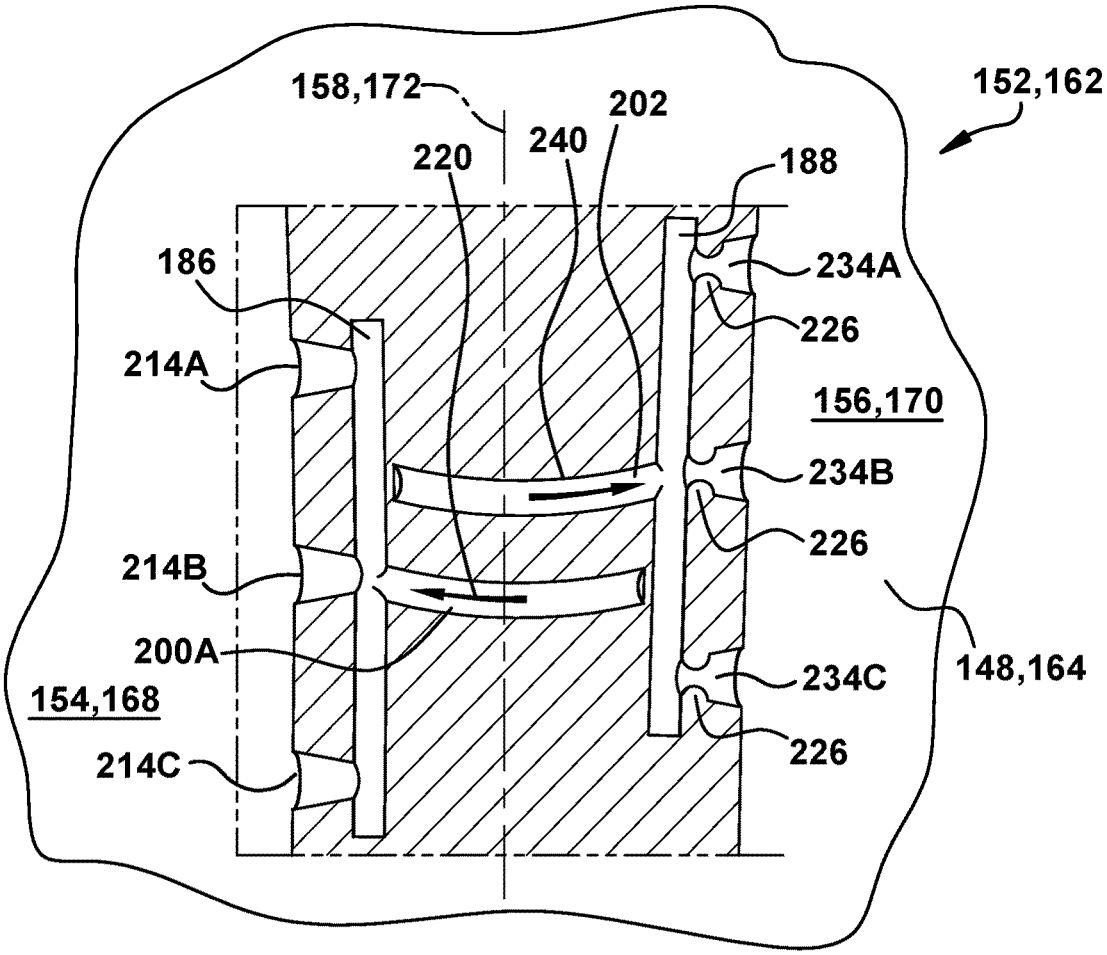
FIG. 12 shows a schematic front view of a turbine airfoil including first and second cooling passages coupled by plenums to respective pluralities of film cooling holes, according to another embodiment of the disclosure.

In FIGS. 5A-5C, each film cooling hole 214, 234 includes a corresponding cooling passage 200, 202. However, this arrangement is not necessary in all cases. FIG. 12 shows a schematic front view of airfoil 152, 162 including cooling passages 200, 202 according to another embodiment of the disclosure. In FIG. 12, at least one of first film cooling holes 214A-C and second film cooling holes 234A-C include a different number of film cooling holes 214 or 234 than a corresponding first cooling passage(s) 200 and second cooling passage(s) 202. That is, at least one of: the plurality of first film cooling holes 214A-C includes a different number of cooling holes 214 than a number of first cooling passage(s) 200; and the plurality of second film cooling holes 234A-C includes a different number of cooling holes 234 than a number of second cooling passage(s) 202. Any arrangement is within the scope of the disclosure.

In the one example shown, a plurality of first film cooling holes 214A-C (three shown) may be supplied with first coolant 220 from a respective single first cooling passage 200. Here, for example, first film cooling holes 214A-C share a plenum 186 coupled to first cooling passage 200. In other non-limiting examples, two first cooling passages 200 may supply plenum 186 coupled to five film cooling holes 214, or three first cooling passages 200 may supply plenum 186 coupled to two film cooling holes 214. Similarly, a plurality of second film cooling holes 234A-C (three shown) may be supplied with second coolant 240 from respective second cooling passage 202. Here, for example, second film cooling holes 234A-C share a plenum 188 coupled to a single second cooling passage 202. In other non-limiting examples, two second cooling passages 202 may supply plenum 188 coupled to five film cooling holes 234, or three second cooling passages 202 may supply plenum 188 coupled to two film cooling holes 234. Any number of cooling passages 200, 202 and film cooling holes 214, 234 may share a plenum 186, 188, respectively, so long as sufficient coolant flow and pressure are present. As noted, one or more second film cooling holes 234 may include a portion 226 with a reduced cross-sectional area compared to plenum 188 and/or second cooling passage(s) 202.

FIG. 12 also shows that at least one of first film cooling holes, e.g., 214A, 214C, may be at a different radial position in body 148, 164 from at least one of first cooling passages 200. Alternatively, or in addition thereto, at least one of the plurality of second film cooling holes, e.g., 234A or 234C, may be at a different radial position in body 148, 164 from at least one of second cooling passages 202. A variety of arrangements is possible.

Figure 13:
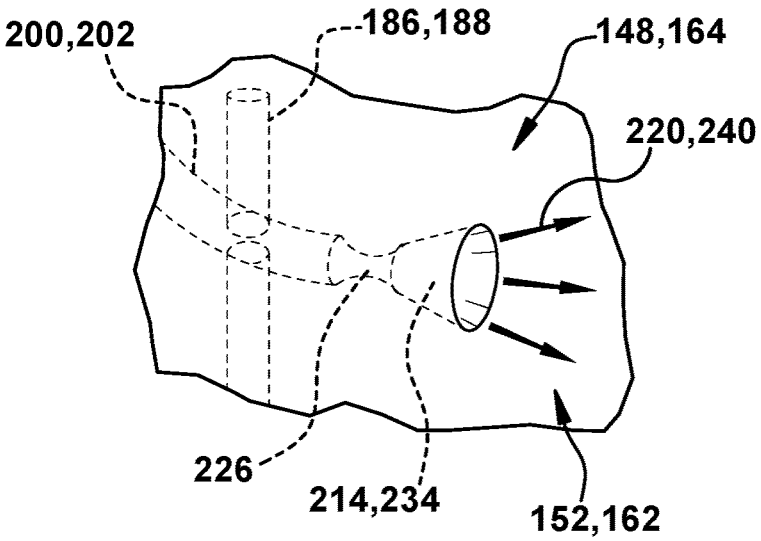
FIG. 13 shows a side view of an illustrative film cooling hole in a body of a turbine airfoil, according to embodiments of the disclosure.

FIG. 13 shows a side view of an illustrative film cooling hole 214, 234 in body 148, 164 of airfoil 152, 162. First and second film cooling holes 214, 234 may take the form of any now known or later developed diffusion opening. That is, the film cooling holes 214, 234 include a fanned or diverging opening, rather than a simple circular 'showerhead' hole, to aid in forming a cooling film along pressure side 154, 168 and suction side 156, 170 of airfoil 152, 162, respectively. Portion 226 having a smaller cross-sectional area is also shown in FIG. 13. The cooling film passes aft-ward along pressure and suction sides to cool an exterior surface of the airfoils 152, 162.

Figure 14:
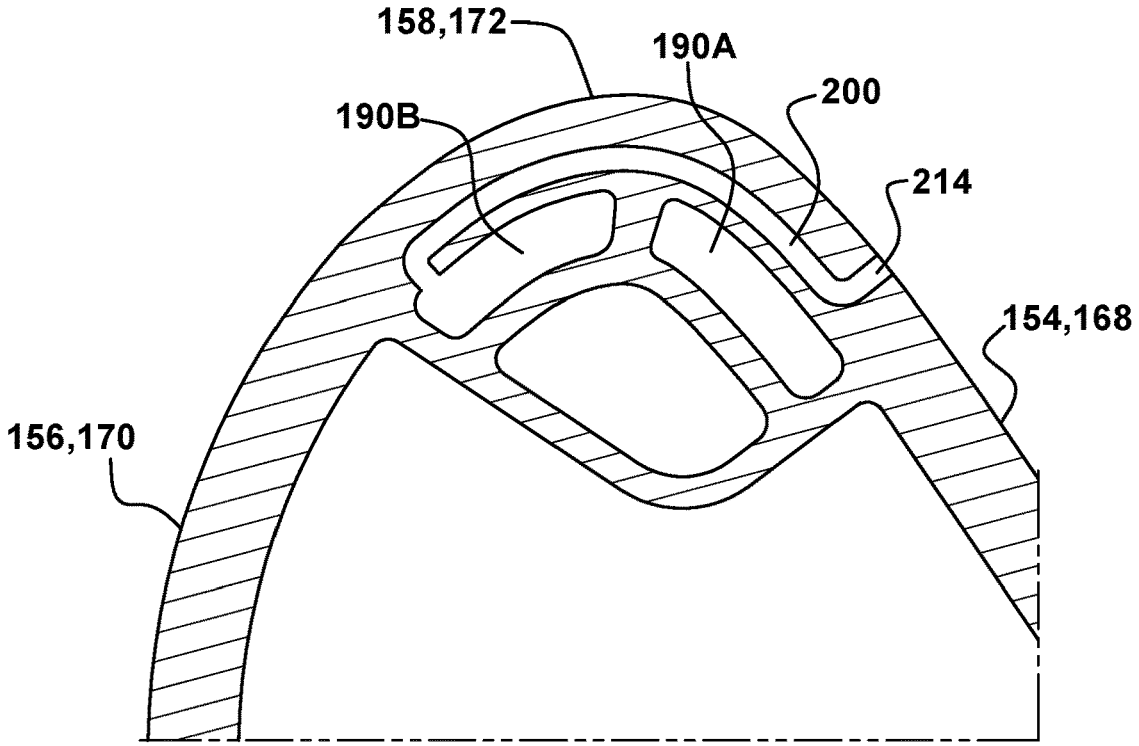
FIG. 14 shows a cross-sectional view of a turbine airfoil through a first cooling passage along view line A-A in FIGS. 5A and 5C, according to other embodiments of the disclosure.
Figure 15:
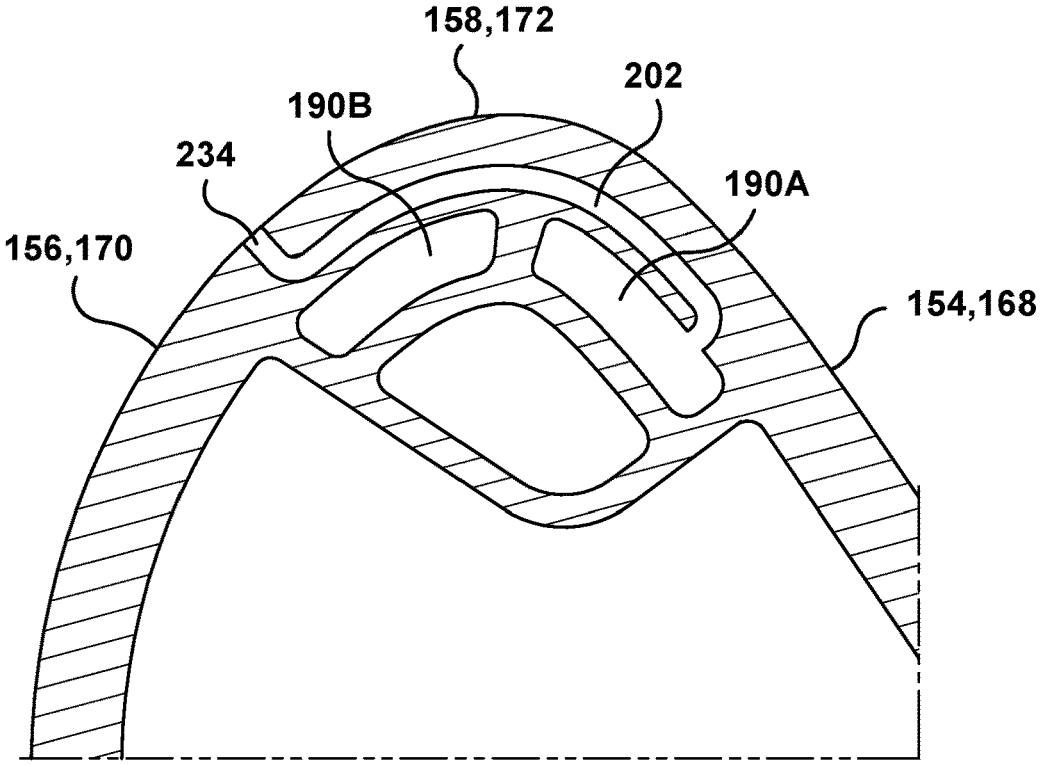
FIG. 15 shows a cross-sectional view of a turbine airfoil through a second cooling passage along view line B-B in FIGS. 5B and 5C, according to other embodiments of the disclosure.

FIG. 14 shows a cross-sectional view through first cooling passage 200 along view line A-A in FIGS. 5A and 5C, and FIG. 15 shows a cross-sectional view through second cooling passage 202 along view line B-B in FIGS. 5B and 5C, according to other embodiments of the disclosure. In these embodiments, first and second film cooling holes 214, 234 are perpendicular to suction side 156, 170 or pressure side 154, 168, respectively, and may be generally circular in cross-section. In this regard, they are 'showerhead' holes, and are not fanned or diverging holes at the side surfaces as in FIG. 13. In any event, the cooling film passes aft-ward along pressure and suction sides to cool an exterior surface of the airfoils. In such embodiments, first and second film cooling holes 214, 234 are directly coupled to first and second cooling passages 200, 202, respectively, in the absence of intervening plenums 186, 188.

Figure 16:
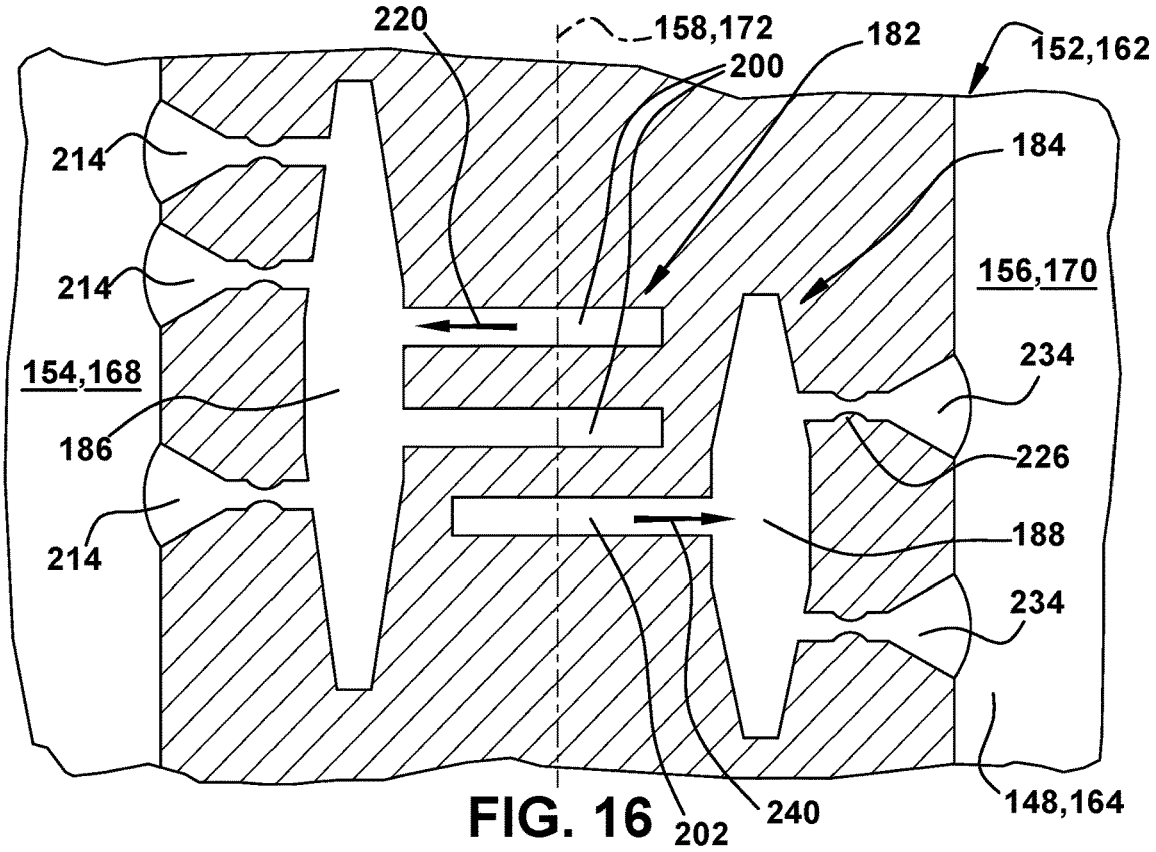
FIG. 16 shows a schematic front view of a turbine airfoil including first and second cooling passages coupled by plenums to respective pluralities of film cooling holes, according to another embodiment of the disclosure.

FIG. 16 shows a schematic partial cross-sectional view of an alternative embodiment. In this embodiment, at least one of first plenum 186 and second plenum 188 may have an inconsistent cross-sectional area. In the non-limiting example shown, both plenums 186, 188 converge to have smaller cross-sectional area from a midpoint to outer ends thereof. Plenum(s) 186, 188 may change cross-sectional area in any manner desired to attain, for example, the desired coolant flow rate, volume, or back pressure, among other factors.

FIGS. 17 and 18 show schematic partial cross-sectional views of other embodiments. FIGS. 17 and 18 show sub-circuits 182, 184 in which cooling passage(s) 200, 202 are not aligned with any corresponding cooling holes 214, 234. As noted, FIG. 7 shows one or more second film cooling holes 234 alone including smaller cross-sectional portion 226, FIG. 17 shows first film cooling hole(s) 214 alone including smaller cross-sectional portion 223 therein to create back pressure, and FIG. 18 shows both first film cooling hole(s) 214 and second film cooling hole(s) 234 including portions 223, 226 having smaller cross-sectional areas.

Cooling passages 200, 202 as used herein may include any now known or later developed turbulators or other heat transfer enhancers (not shown) to increase transfer of heat from coolant 220, 240 passing therethrough.

Airfoil 152, 162 may be formed using any manufacturing technique such as but not limited to casting or additive manufacture. Where airfoil 152, 162 is cast, cooling passages 200, 202 may be formed by any now known or later developed methods for forming a curved passage, e.g., sequential drilling, electric discharge machining, etc.

A method of cooling a turbine airfoil, and particularly its leading edge, according to embodiments of the disclosure will now be described. The method occurs in a turbine airfoil 152, 162 including body 148, 164 including wall 150, 166 defining pressure side 154, 168, suction side 156, 170, and leading edge 158, 172 extending (generally radially) between pressure side 154, 168 and suction side 156, 170. Embodiments of the method may include performing inside first cooling passage(s) 200, flowing first coolant 220 from first coolant source 210 in suction side 156, 170 around leading edge 158, 172 to first plenum 186 and then to plurality of first film cooling holes 214 through wall 150, 166 on pressure side 154, 168. Alternatively, or in addition thereto, the method may include performing inside second cooling passage(s) 202, flowing second coolant 240 from second coolant source 230 from pressure side 154, 168 around leading edge 158, 172 to second plenum 188 and then to second film cooling holes 234 through wall 150, 166 on suction side 156, 170.

As noted, a plurality of first cooling passages 200 and a plurality of second cooling passages 202 may be provided together. In this case, the method may include flowing first coolant 220 from first coolant source 210 from suction side 156, 170 to pressure side 154, 168 in each of the first cooling passages 200, and flowing second coolant 240 from second coolant source 230 from pressure side 154, 168 to suction side 156, 170 in each of second cooling passages 202. The plurality of first cooling passages 200 may, for example, alternate with the plurality of second cooling passages 202 radially along leading edge 158, 172 of airfoil 152, 162. As noted previously, other patterns are also possible.

In certain embodiments, first and second cooling passages 200, 202 may each have an average cross-sectional area of no greater than 0.1 square millimeters. The cross-sectional area of cooling passages 200, 202 may vary along their lengths to modulate heat transfer and/or control pressure/flow through the passages. For example, one or more cooling passages 200, 202 and/or film cooling holes 214, 234 may include a smaller cross-sectional area (neck down) upstream of respective the exits of holes 214, 234 to provide a metering region for flow control. In particular, a back pressure may be created in at least one of: a) first plenum 186 and first cooling passage(s) 200 by providing one or more first film cooling holes 214 with a portion 223 (FIGS. 17 and 18) having a smaller cross-sectional area than first cooling passage(s) 200; and b) second plenum 188 and second cooling passage(s) 202 by providing one or more of second film cooling holes 234 with a portion 226 (see e.g., FIGS. 7, 9, 10, 12, 13, and 18) having a smaller cross-sectional area than each of second cooling passage(s) 202. As previously described, first coolant source 210 and second coolant source 230 may be a single coolant supply chamber 190A (FIGS. 6 and 7) inside body 148, 164, or more than one coolant supply chamber 190 may be used.

Embodiments of the disclosure provide relatively small cooling passages (e.g., microchannels having average cross-sectional area of no greater than 0.1 square millimeters) at the leading edge of a turbine airfoil, wrapping around the leading edge. The cooling passages are fed coolant, e.g., cooling air, from the airfoil interior, which flows through the cooling passages in the leading edge. The coolant is then exhausted through film cooling hole(s) to provide further cooling to the airfoil downstream of the leading edge. Each cooling sub-circuit and related cooling passages reduce the amount of coolant required to cool the leading edge because the coolant absorbs more heat along the relatively longer cooling passages (compared to showerhead openings), which improves efficiency and output of the turbomachine. Where both sub-circuits are provided, the cooling passages communicating coolant in opposing directions may further reduce the amount of coolant required to cool the leading edge because the coolant absorbs more heat along the relatively longer cooling passages.

In addition, since the cooling passages communicate coolant around the leading edge of the airfoil, the coolant can be exhausted through shaped film cooling holes that provide better film coverage and cooling further downstream from the leading edge, compared to circular 'showerhead' cooling holes. The number of film cooling holes can also be reduced, simplifying coating clean-up for the airfoil, e.g., of bond and/or thermal barrier coatings. The plenums provide a fluid coupling between the cooling passages and the film cooling holes preventing ingestion of a working fluid where an opening arises in the leading edge.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and their practical application and to enable others of ordinary skill in the art to understand the disclosure such that various modifications as are suited to a particular use may be further contemplated.

What is claimed is:

1. A turbine airfoil, comprising:

a body including a wall defining a pressure side, a suction side, and a leading edge extending between the pressure side and the suction side; and a cooling circuit inside the wall of the body, the cooling circuit including at least one of:

a) a suction side to pressure side cooling sub-circuit including at least one first cooling passage extending inside the wall of the body from the suction side to the pressure side around the leading edge to a first plenum defined in the wall on the pressure side, and a plurality of first film cooling holes in fluid communication with the first plenum and extending through the wall on the pressure side, wherein a first coolant from a first coolant source flows in the at least one first cooling passage and the first plenum and exits through the plurality of first film cooling holes; and b) a pressure side to suction side cooling sub-circuit including at least one second cooling passage extending inside the wall of the body from the pressure side to the suction side around the leading edge to a second plenum defined in the wall on the suction side, and a plurality of second film cooling holes in fluid communication with the second plenum and extending through the wall on the suction side, wherein a second coolant from a second coolant source flows in the at least one second cooling passage and the second plenum and exits through the plurality of second film cooling holes.

2. The turbine airfoil of claim 1, wherein the cooling circuit includes both the pressure side to suction side cooling sub-circuit and the suction side to pressure side cooling sub-circuit.

3. The turbine airfoil of claim 2, wherein the at least one first cooling passage includes a plurality of first cooling passages, and the at least one second cooling passage includes a plurality of second cooling passages, and wherein the plurality of first cooling passages alternates with the plurality of second cooling passages radially along the leading edge of the airfoil.

4. The turbine airfoil of claim 1, wherein at least one of:

a) the plurality of first film cooling holes includes a portion having a smaller cross-sectional area than the at least one first cooling passage, creating a back pressure in the first plenum and the at least one first cooling passage; and b) the plurality of second film cooling holes includes a portion having a smaller cross-sectional area than the at least one second cooling passage, creating a back pressure in the second plenum and the at least one second cooling passage.

5. The turbine airfoil of claim 1, wherein the at least one first cooling passage and the at least one second cooling passage each have an average cross-sectional area of no greater than 0.1 square millimeters.

6. The turbine airfoil of claim 1, wherein the first coolant source and the second coolant source are fluidly separated in the body by a separation wall.

7. The turbine airfoil of claim 1, wherein at least one of:

a) at least one of the plurality of first film cooling holes is at a different radial position in the body from the at least one first cooling passage, and b) at least one of the plurality of second film cooling holes is at a different radial position in the body from the at least one second cooling passage.

8. The turbine airfoil of claim 1, wherein at least one of:

a) the plurality of first film cooling holes includes a different number of film cooling holes than a number of the at least one first cooling passage, and b) the plurality of second film cooling holes includes a different number of film cooling holes than a number of the at least one second cooling passage.

9. The turbine airfoil of claim 1, wherein at least one of the first plenum and the second plenum have an inconsistent cross-sectional area.

10. The turbine airfoil of claim 1, wherein the body is coupled to a radially inner platform at a radially inner end thereof and to a radially outer platform at a radially outer end thereof, forming a turbine nozzle.

11. A turbine nozzle, comprising:

an airfoil body including a wall defining a pressure side, a suction side, and a leading edge extending between the pressure side and the suction side;

a radially inner platform coupled to the airfoil body at a radially inner end thereof and a radially outer platform coupled to the airfoil body at a radially outer end thereof; and a cooling circuit inside the wall of the body, the cooling circuit including at least one of:

a) a suction side to pressure side cooling sub-circuit including at least one first cooling passage extending inside the wall of the body from the suction side to the pressure side around the leading edge to a first plenum defined in the wall on the pressure side, and a plurality of first film cooling holes in fluid communication with the first plenum and extending through the wall on the pressure side, wherein a first coolant from a first coolant source flows in the at least one first cooling passage and the first plenum and exits through the plurality of first film cooling holes; and b) a pressure side to suction side cooling sub-circuit including at least one second cooling passage extending inside the wall of the body from the pressure side to the suction side around the leading edge to a second plenum defined in the wall on the suction side, and a plurality of second film cooling holes in fluid communication with the second plenum and extending through the wall on the suction side, wherein a second coolant from a second coolant source flows in the at least one second cooling passage and the second plenum and exits through the plurality of second film cooling holes.

12. The turbine nozzle of claim 11, wherein the cooling circuit includes both the pressure side to suction side cooling sub-circuit and the suction side to pressure side cooling sub-circuit; and wherein the at least one first cooling passage includes a plurality of first cooling passages, and the at least one second cooling passage include a plurality of second cooling passages; and wherein the plurality of first cooling passages alternates with the plurality of second cooling passages radially along the leading edge of the airfoil.

13. The turbine nozzle of claim 11, wherein at least one of:

a) the plurality of first film cooling holes includes a portion having a smaller cross-sectional area than the at least one first cooling passage, creating a back pressure in the first plenum and the at least one first cooling passage; and b) the plurality of second film cooling holes includes a portion having a smaller cross-sectional area than the at least one second cooling passage, creating a back pressure in the second plenum and the at least one second cooling passage.

14. The turbine nozzle of claim 11, wherein the first coolant source and the second coolant source are fluidly separated in the body by a separation wall.

15. The turbine nozzle of claim 11, wherein at least one of:

a) at least one of the plurality of first film cooling holes is at a different radial position in the airfoil body from the at least one first cooling passage, and b) at least one of the plurality of second film cooling holes is at a different radial position in the airfoil body from the at least one second cooling passage.

16. The turbine nozzle of claim 11, wherein at least one of:

a) the plurality of first film cooling holes includes a different number of film cooling holes than a number of the at least one first cooling passage, and b) the plurality of second film cooling holes includes a different number of film cooling holes than a number of the at least one second cooling passage.

17. The turbine nozzle of claim 11, wherein at least one of the first plenum and the second plenum have an inconsistent cross-sectional area.

18. A method of cooling a turbine airfoil, the method comprising:

in the turbine airfoil including a body including a wall defining a pressure side, a suction side, and a leading edge extending between the pressure side and the suction side, performing at least one of:

a) inside at least one first cooling passage, flowing a first coolant from a first coolant source in the suction side around the leading edge to a first plenum and then to a plurality of first film cooling holes through the wall on the pressure side; and b) inside at least one second cooling passage, flowing a second coolant from a second coolant source from the pressure side around the leading edge to a second plenum and then to a plurality of second film cooling holes through the wall on the suction side.

19. The method of claim 18, wherein the performing includes performing both a) and b), and wherein the at least one first cooling passage includes a plurality of first cooling passages and the at least one second cooling passage includes a plurality of second cooling passages, and wherein the plurality of first cooling passages alternates with the plurality of second cooling passages radially along the leading edge of the airfoil.

20. The method of claim 18, further comprising creating a back pressure in at least one of:

a) the first plenum and the at least one first cooling passage by providing at least one of the plurality of first film cooling holes with a portion having a smaller cross-sectional area than the at least one first cooling passage; and b) the second plenum and the at least one second cooling passage by providing at least one of the plurality of second film cooling holes with a portion having a smaller cross-sectional area than the at least one second cooling passage.

* * * * *